US006193358B1

(12) United States Patent
Fujita et al.

(10) Patent No.: US 6,193,358 B1
(45) **Date of Patent: *Feb. 27, 2001**

(54) PRINTING APPARATUS

(75) Inventors: Miyuki Fujita, Tokyo; Masao Maeda, Kawasaki; Minako Kato, Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/015,790

(22) Filed: Jan. 29, 1998

(30) Foreign Application Priority Data

Jan. 31, 1997 (JP) ..... 9-019319

(51) Int. Cl.[7] ..... B41J 2/15
(52) U.S. Cl. ..... 347/41; 347/43
(58) Field of Search ..... 347/41, 43, 20, 347/40, 10, 47, 54, 44

(56) References Cited

U.S. PATENT DOCUMENTS

| | | | | |
|---|---|---|---|---|
| 4,313,124 | | 1/1982 | Hara | 347/57 |
| 4,345,262 | | 8/1982 | Shirato et al. | 347/10 |
| 4,459,600 | | 7/1984 | Sato et al. | 347/47 |
| 4,463,359 | | 7/1984 | Ayata et al. | 347/56 |
| 4,558,333 | | 12/1985 | Sugitani et al. | 347/65 |
| 4,608,577 | | 8/1986 | Hori | 347/66 |
| 4,723,129 | | 2/1988 | Endo et al. | 347/56 |
| 4,740,796 | | 4/1988 | Endo et al. | 347/56 |
| 5,748,207 | * | 5/1998 | Inui et al. | 347/43 |
| 5,847,721 | * | 12/1998 | Ogata et al. | 347/41 |

FOREIGN PATENT DOCUMENTS

| | | |
|---|---|---|
| 54-056847 | 5/1979 | (JP) . |
| 62-41114 | 9/1980 | (JP) . |
| 59-123670 | 7/1984 | (JP) . |
| 59-138461 | 8/1984 | (JP) . |
| 60-071260 | 4/1985 | (JP) . |
| 6-47290 | 4/1986 | (JP) . |

* cited by examiner

*Primary Examiner*—N. Le
*Assistant Examiner*—Lamson D. Nguyen
(74) *Attorney, Agent, or Firm*—Fitzpatrick, Cella, Harper & Scinto

(57) ABSTRACT

Per every one printing scan of a head, a printing data to be printed by the corresponding scan is divided into L in a scanning direction (lateral direction) and N in a paper feeding direction (longitudinal direction. Concerning each counting blocks identified by l and number of driving $r_{ln}$ is counted. Then, with respect to each l, $r_{ln}$ are sequentially summed from n=1 to obtain $S_l$. At every time of summing for deriving $S_l$, judgment is made whether $S_l$ is greater than a predetermined value R determined in association with a power source capacity. When judgment is made that $S_l$ is greater than R, printing of a printing data corresponding to the counting blocks of 1 to (n−1) with respect to n−1 which is one smaller value that the value n of the counting block upon judgment that $S_l$ is greater than R, is performed, and then paper feeding is performed for the corresponding counting blocks. Thus, lowering of throughput can be restricted with optimally using the power source capacity of the apparatus.

18 Claims, 19 Drawing Sheets n: LONGITUDINAL COUNTING BLOCK NUMBER n=1~N
N: FINAL COUNTING BLOCK NUMBER
ℓ: LATERAL COUNTING BLOCK NUMBER ℓ=1~L
L: FINAL COUNTING BLOCK NUMBER n: LONGITUDINAL COUNTING BLOCK NUMBER n=1～N
N: FINAL COUNTING BLOCK NUMBER
ℓ: LATERAL COUNTING BLOCK NUMBER ℓ=1～L
L: FINAL COUNTING BLOCK NUMBER n: LONGITUDINAL COUNTING BLOCK NUMBER n=1～N
N: FINAL COUNTING BLOCK NUMBER
ℓ: LATERAL COUNTING BLOCK NUMBER ℓ=1～L
L: FINAL COUNTING BLOCK NUMBER

PRINTING APPARATUS

This application is based on patent application Ser. No. 019319/1997 filed Jan. 31, 1997 in Japan, the content of which is incorporated hereinto by reference.

BACKGROUND OF THE INVENTION

1. Field of the Invention

The present invention relates generally to a printing apparatus. More specifically, the invention relates to a printing apparatus which has a construction to efficiently use a power source capacity.

2. Description of the Related Art

Associating with spreading of information processing apparatuses, such as copy machines, wordprocessors, computers and the like, and communication apparatus, printing apparatus which performs digital image printing in an ink-jet system, as one of image forming (printing) apparatus for outputting information, such as a character, an image and so forth, processed by the foregoing apparatuses, are spreading. In such ink-jet printing apparatus, it is typical to employ a printing head, in which a plurality of ink ejection openings and liquid passages are integrated, as a plurality of printing elements in order to improve a printing speed or so on.

Among these ink-jet printing apparatus, a serial printer which is one of low cost and can be down-sized easily, holds high demand for a personal use. In the printer, it is possible that an amount of information varies significantly depending upon content of an image data fed from a host computer, and an uneven distribution of printing dot density is present depending upon printing portions in a predetermined region, such as one page of a printing paper, to cause significant fluctuation of necessary electric power for driving a printing head and printing amount. When there are provided with a power source having sufficiently large capacity and a circuit withstanding for inputting and outputting of such large capacity power source to enable even printing despite of the fluctuation of electric power or the like, the printer becomes bulky and expensive.

On the other hand, in general printing, high density printing to be printed by a maximum printing amount of the head is quite a little in a whole image, and most part of the image can be printed by a low density driving output. Therefore, in printers or the like which are intended to realize a lower price and a smaller size, there has been proposed a method in which, instead of employing the power source having large capacity, an amount of electric power to be used within an unit period is restricted by controlling a printing manner according a number of printing dots to be printed on a given size of region, and whereby, in case of the general image data, a printing quality is compensated even in a portion having high printing density.

For example, Japanese Patent Application Publication No. 41114/1987 discloses a printing apparatus which is arranged a plurality of printing elements along a paper feeding direction and performs printing by scanning each printing elements in a direction perpendicular to the paper feeding direction for performing printing. The disclosed printing apparatus comprises printing signal generating means for generating a printing element driving signal for driving the printing elements for expressing a character pattern of each character with dividing characters in one line into a plurality of blocks per n in number of columns, counting means for taking the printing element driving signal from the driving signal generating means as a counting input and for counting number of necessary printing dots for printing each character in each block, detecting means for detecting levels of the counted values per each block counted by the counting means among a preliminarily set plurality of levels, and selecting means receiving an output of the detecting means for selecting a printing speed of one line depending upon the levels of the counted values of the counting means in the block, at which number of printing dots in one line becomes maximum.

While the technology disclosed in the above-identified publication has been proposed in view of a wire-dot system or line printer, it reduces power consumption per unit period by lowering the printing speed for one line.

As another method, there is a method to divide data for a region to be printed once into a plurality of fractions and scan the printing head for a plurality times for the same region. For instance, in Japanese Patent Application Publication No. 47290/1994, there is a disclosure "when a dot duty detecting region, in which dot duty exceeds a predetermined dot duty, is present, the corresponding printing line is printed dividingly for a plurality of times". Then, as a particular method of printing for a plurality of times, an example of printing with dividing for twice printing by the odd sequential number of printing elements and by the even sequential number of printing elements, as shown in FIG. 1A.

As the method to divide the region to be printed in one line by the printing head into two divided regions, methods shown in FIGS. 1B and 1C are also considered. FIG. 1B shows a method, in which for printing elements in a head, all of the printing elements in the head is divided into an upper half block and a lower half block to perform a first scan for printing only by the upper half block and a second scan for printing only by the lower half block. On the other hand, in FIG. 1C, with a mutually complementary two printing masks (here in a form of a grid), printing for an image region D is completed by twice of printing scan. In any cases, the mutual difference between the methods illustrated in FIGS. 1A to 1C is merely in how printing of the image region D is divided into two.

Further, the number of division in these method is not limited to two. Even in the above-identified publication, there is a statement "it is not specified to twice, but can be printed dividingly for more than or equal to twice." It should be noted that there is not a difference in terms of the plurality of times of printing scan for the image region.

However, when the foregoing two conventional methods are applied for an ink-jet printing apparatus, they may encounter the following problems.

When the technology disclosed in the former Japanese Patent Application Publication No. 41114/1987 is applied for a printing apparatus of an ink-jet system, an image is formed with lowering a speed of a carriage mounting the head and a driving frequency of the head, depending upon the number of the printing dots. In this case, in the ink-jet system, a precision of a hitting position and an ejection amount per one dot are affected by the carriage speed and the driving frequency to cause a difference of density between a region printed at low speed and a region printed at a normal speed to make unevenness perceptible on the printed image. While such fluctuation of density may be adjusted by ejection amount control or the like, the apparatus becomes large scale, and a low cost printer cannot be adapted.

Even by the dividing method disclosed in the later Japanese Patent Application Publication No. 47290/1994, which includes a derivative example as shown in FIG. 1, an influence may be perceptible in the image density. Namely, as shown in FIGS. 1A and 1C, when an imaging region is divided into a uniform pattern for a plurality of times of printing scans, it has been observed by the inventors that the density of the image formed by a plurality of times of printing scans becomes higher than the printing image formed by once of printing scan. Even in this case, the density of the printed image only in the region dividedly printed becomes high, as in the former prior art. In contrast to this, it has been confirmed that, by the method as shown in FIG. 1B, in which upper and lower blocks of the printing elements of the head are dividingly driven, the foregoing problem will not be caused.

FIG. 2 is an illustration showing a printing condition, in which the method of FIG. 1B is applied. Here, a head, in which sixty-four ejection openings are arranged, is employed to perform printing divided into twice by respective thirty-two ejection openings in a power saving mode.

In FIG. 2, the printing in the first scan shows the case where printing can be performed by both of the upper and lower half blocks (by all ejection openings). After printing scan by all of sixty-four ejection openings, paper feeding is performed for an amount corresponding to sixty-four ejection openings. Next, in the second printing scan, since it is detected that the number of the printing dots is greater than or equal to a predetermined number, it is indicated that printing is performed only by the block 1. It should be noted that paper feeding after printing scan is not performed. Subsequently, in the third printing scan, printing scan is performed with remaining thirty-two ejection openings of the block 2 of the head. Thereafter, paper feeding for sixty-four ejection openings is performed. Then, the fourth and fifth scans are also performed for forming image in the similar manner to those of the second and third scans. By progressing printing, with data of any density distribution, the image can be completed with relatively small power source capacity.

However, in the foregoing prior art, when a certain predetermined number of printing dots is exceeded, a control for switching into a given power saving mode sufficiently restricting power consumption, is performed. Therefore, it cannot be said that the power source can be efficiently utilized within an allowable range of use of the power source. Namely, an operational mode enters into the power saving mode even if number of dots slightly exceeds a threshold value, it becomes difficult to use the power close to a maximum capacity of the power source capacity, in practice to merely prolong printing period, significantly.

SUMMARY OF THE INVENTION

The present invention has been worked out for solving the problems set forth above. Therefore, it is an object of the present invention to provide a printing apparatus and a printing method which can optimally use a power source capacity without unnecessarily lower throughput.

Another object of the present invention is to provide a printing apparatus and a printing method, in which number of timing of driving of printing elements in each scan is detected in relation to a size of a partial region of the scanning region, the number of the printing element to be driven in the corresponding scan is corresponded to the partial region, about which detection is made, when the detected value exceeds a predetermined value to be determined depending upon a given power source capacity of the apparatus, and a feeding amount of a printing medium is set at an amount corresponding to the partial region so that reduction of the printing region by restriction of a power source capacity is minimized with optimally using the power source capacity.

In a first aspect of the present invention, there is provided a printing apparatus performing printing based on printing data by using a printing head, in which a plurality of printing elements are arranged, with scanning the printing head with respect to a printing medium in a direction different from a direction of an arrangement of the printing elements, comprising:

driving means for driving the plurality of printing elements of the printing head;

transport means for transporting the printing medium;

restriction means for restricting number of printing elements to be driven in one scanning of the printing head so that the number of driving the plurality of printing elements driven at predetermined extent by the driving means during the one scanning becomes less than predetermined number; and transport control means for controlling transportation of the printing medium by the transport means in a manner that an amount of the transportation corresponds to the number of printing elements restricted by the restriction means in the one scanning after the one scanning of the printing head.

In a second aspect of the present invention, there is provided a printing method for performing printing based on printing data by using a printing head, in which a plurality of printing elements are arranged with scanning the printing head with respect to a printing medium in a direction different from a direction of an arrangement of the printing elements, comprising the steps of:

driving the plurality of printing elements of the printing head;

transporting the printing medium;

restricting number of printing elements to be driven in one scanning of the printing head so that the number of driving the plurality of printing elements driven at predetermined extent during the one scanning becomes less than predetermined number; and controlling transportation of the printing medium in a manner that an amount of the transportation corresponds to the number of printing elements restricted in one scanning, after the one scanning of the printing head.

In a third aspect of the present invention, there is provided a printing method for performing printing based on printing data by using a printing head, in which a plurality of printing elements are arranged, with scanning the printing head with respect to a printing medium in a direction different from a direction of an arrangement of the printing elements, comprising the steps of:

detecting number of driving the printing elements of the printing head with sequentially varying a size of a partial region obtained by dividing a scanning region of the printing head in a direction of the arrangement of the printing elements;

making judgment whether sequentially detected number of driving is greater than a predetermined value or not; and performing printing by driving only the plurality of printing elements of the printing head corresponding to the partial region of the size relating to detection while scanning in the scanning region when judgment is made that the number of driving is greater than the predetermined value.

The above and other objects, effects, features and advantages of the present invention will become apparent from the following description of embodiments thereof taken in conjunction with the accompanying drawings.

DESCRIPTION OF THE PREFERRED EMBODIMENT

The preferred embodiments of the present invention will be described hereinafter in detail with reference to the accompanying drawings.

(First Embodiment)

Figure 3:
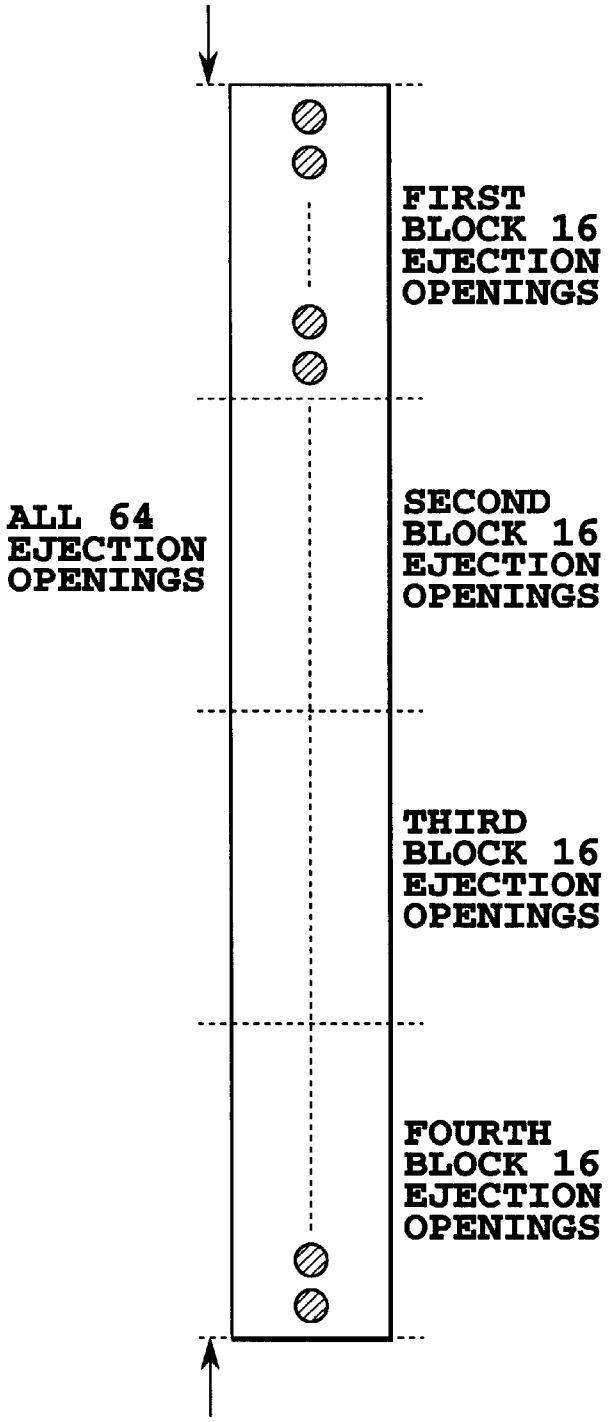
FIG. 3 is an illustration showing a construction of the first embodiment of a head and its ejection openings.

The shown embodiment represents a case where particularly a character image is printed at high speed in a so-called monochrome printer. FIG. 3 diagrammatically show an ejection opening array of a printing head to be employed in the shown embodiment. The shown printing head is adapted for a printing density of 600 dpi, in which sixty-four ejection openings as printing elements are linearly arranged at a pitch of 600 dpi, namely about 42.3 mm interval. Amount of an ink droplet to be ejected from respective ejection openings is substantially constant and is about 15 pl/drop.

Figure 4:
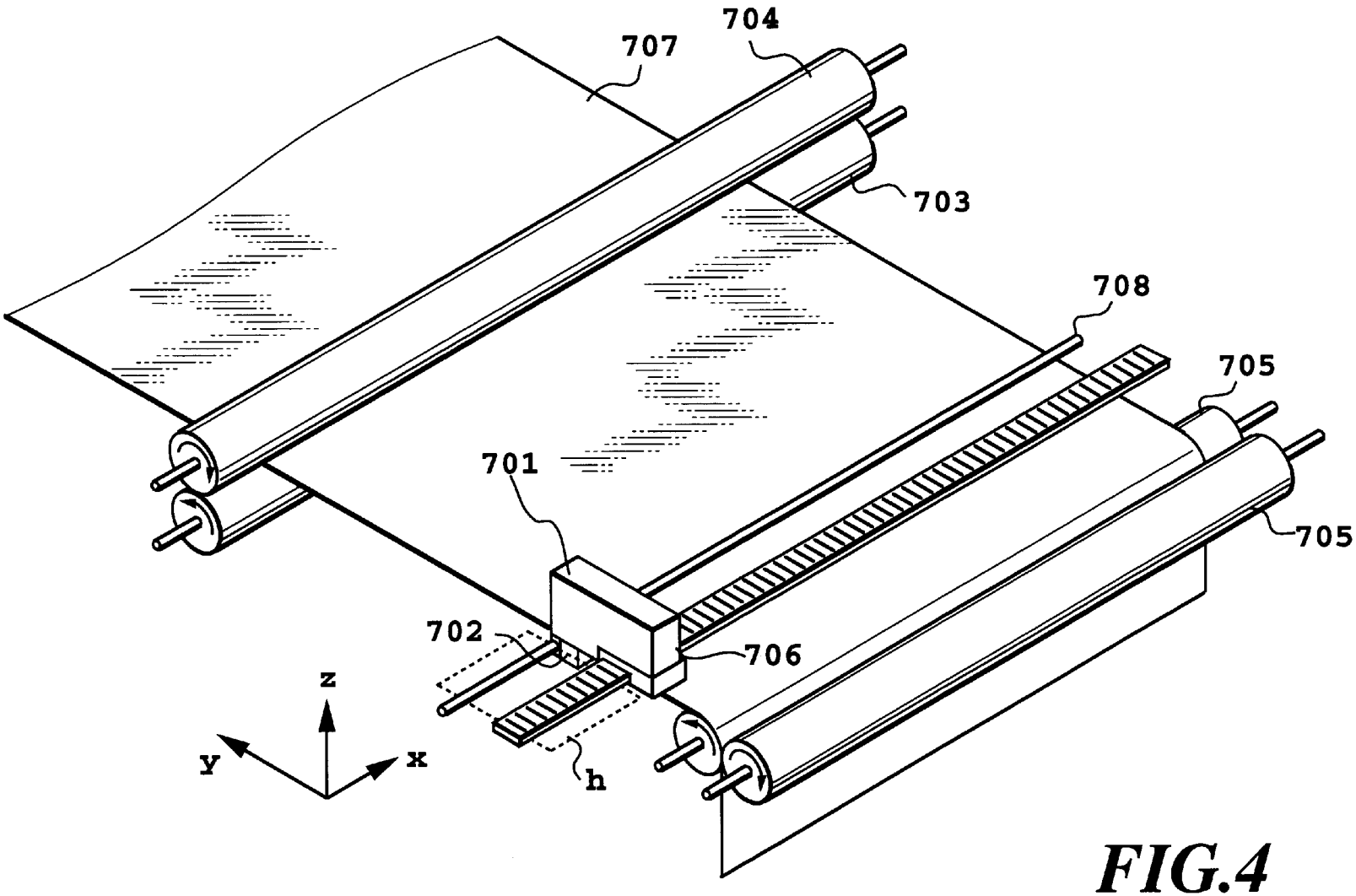
FIG. 4 is a perspective view showing a general construction of an ink-jet printing apparatus used in one embodiment of the present invention.

FIG. 4 is an illustration generally showing a major construction of the shown embodiment of an ink-jet printer employing the foregoing printing head.

The shown embodiment is directed to a monochrome printer printing using only black ink. An ink tank 701 storing the black ink and a printing head 702 are detachably mounted on a carriage 706.

In FIG. 4, a paper feeding roller 703 rotates in a direction of arrow in the drawing with gripping a printing paper 707 together with an auxiliary roller 704. By this, the printing paper 707 is transported in the direction y of the drawing. On the other hand, a pair of the feeding roller 705 performs paper feeding, and, in conjunction therewith, provides a given tension for the printing paper 707 by appropriately adjusting a relationship of rotation speeds of the rollers 703 and 704. A carriage 706 slidably engages with a guide shaft 708 and whereby movable along the guide rail for scanning. The carriage is placed in stand-by state at a home position (h) shown by broken line in FIG. 4. On the other hand, at this position, capping is performed for the head by a not shown capping means to prevent increasing of viscosity of an ink, and in conjunction therewith, a predetermined suction recovery process may be performed.

Before starting printing, the carriage 706 located at the home position h is responsive to a printing start command to perform ink ejection from sixty-four ejection openings on the printing head 702 depending upon an image data. By this, character and image may be printed on the printing paper. Once printing up to a predetermined position at the end portion of the paper is completed, the carriage 702 returns to the home position to perform printing associated with scanning in the x direction. In the alternative, at a reciprocal printing mode, ink ejection is performed also in scanning of -x direction. In a period from completion of scanning for printing to starting of next printing scan, a paper feeding in a direction y in a predetermined amount is performed by rotatingly driving the paper feeding roller 703. As set forth above, per every scan of the carriage, printing scan and paper feeding are alternately repeated for completing printing of the data image on one sheet of the paper surface.

The shown embodiment of the ink-jet printing apparatus of FIG. 4, as set forth above, includes known CPU, RAM, ROM and so on as a control portion to perform the following control for printing operation.

In the construction set forth above, the shown embodiment divides sixty-four ejection openings of the head into a predetermined number of blocks. This will be explained with reference to FIG. 3. In FIG. 3, the sixty-four ejection openings on the head is divided into four blocks, each of which contains sixteen ejection openings. In the shown embodiment, in order to perform printing using the blocks as much as possible within a range not exceeding a useful maximum power, number of printing blocks is variable per one block.

Figure 5:
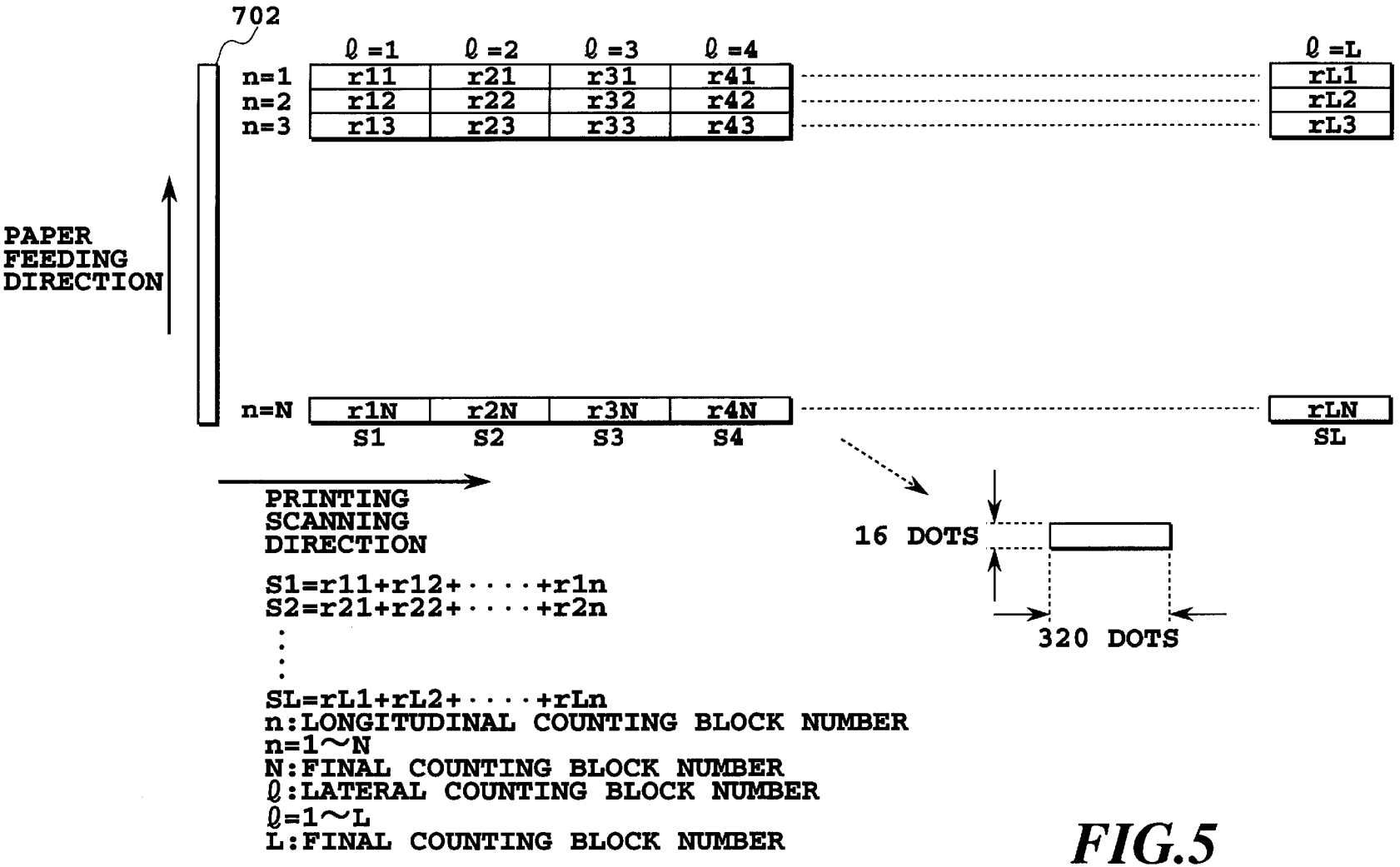
FIG. 5 is an illustration for general description of a counting block for counting number of times of driving in a first embodiment of the present invention.

FIG. 5 is an illustration for explaining the principle of a counting the block for counting number of printing dots, to be employed in the shown embodiment.

As shown in FIG. 5, data for one scan of the head, namely data of (number of ejection openings)×(number of dots of each line in the scanning direction) is equally divided into N in number in the alignment direction of the ejection openings, namely the paper feeding direction, and L in number in the scanning direction so as to establish longitudinal N×lateral L of divided counting blocks.

In the case of the shown embodiment, in the longitudinal direction, sixty-four ejection openings are divided as N=4, and in the lateral (scanning) direction, a printing width 8 inches is divided as L=15. Further, since a resolution in printing is 600 dpi, in each block, data of ejection "1" or not ejection "0" is corresponded to each of longitudinal 16×lateral 320 of pixels.

In FIG. 5, $r_{1n}$ is number of driving obtained by counting only data of ejection "1" in the counting block of a first in lateral direction and a n-th in the longitudinal direction. Furthermore, $S_1$ is a sum obtained by summing $r_{11}$ to $r_{1n}$ as numbers of driving of respective counting blocks of the first in the lateral direction.

Figure 6:
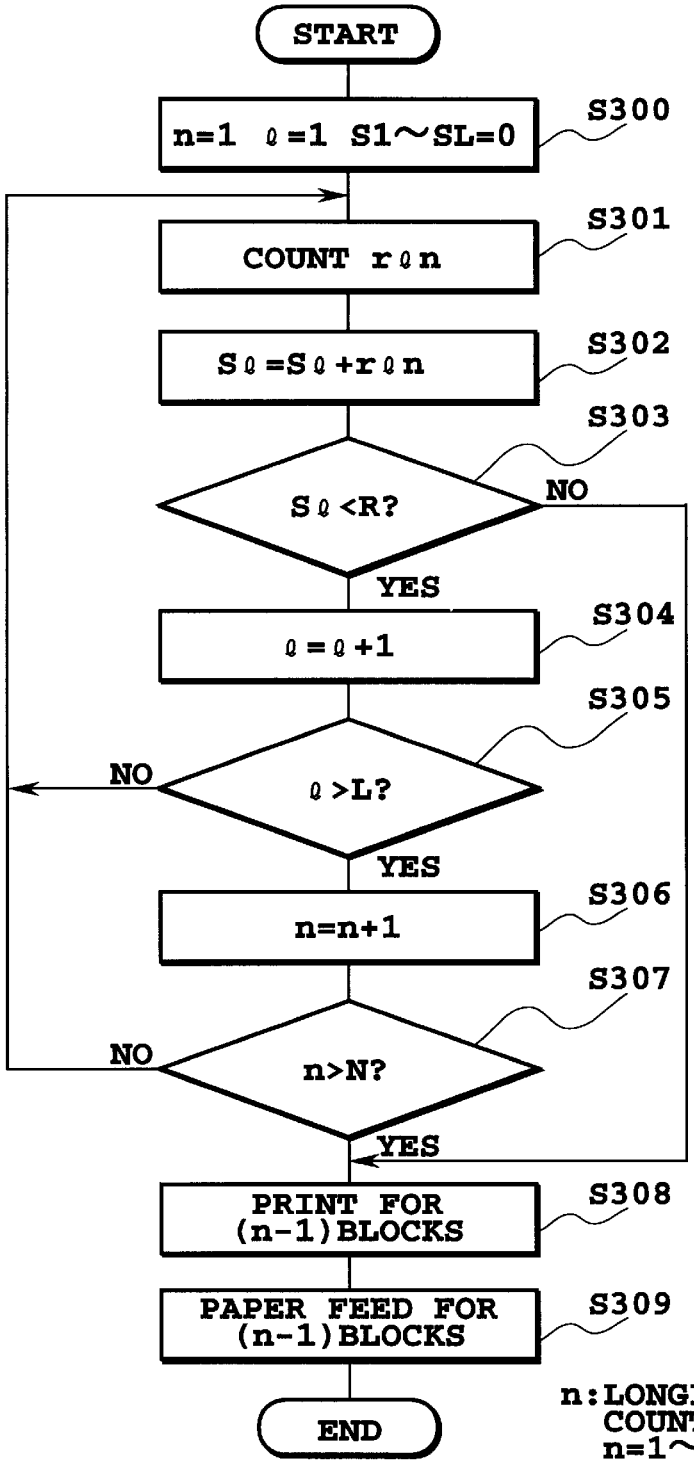
FIG. 6 is a flowchart showing a process for determining number of the ejection openings to be driven in the first embodiment.

FIG. 6 is a flowchart showing a process for determining number of printing blocks to be executed every scan in the shown embodiment.

A value R to be used in this process represents an upper limit of number of driving in the case where printing is performed on the basis of data corresponding to one counting block and is a value determined in view of a power source capacity of the main body of the shown apparatus, a power required for printing one dot, a driving frequency or the like. Here, R has to be a value for permitting satisfactory print without any restriction, such as by the power source capacity and so on even when all of data corresponding to at least one counting block represent ejection "1". In other words, it is desirable to determine a size of the counting block depending upon a specification of the apparatus, such as the power source capacity and so on.

In further detail, in the foregoing counting block, the following is a reason why not only the data of only one column in the longitudinal direction to be driven simultaneously but also the data in the lateral (scanning) direction.

In general, a capacitor is employed for supplying a driving power. With the capacity of the capacitor, data of several columns in the scanning direction may be printed. Namely, on a basis of an amount of power to be used for printing one dot, an amount of power to be consumed associating with printing can be calculated. By comparison of the calculated power consumption value and an amount of power to be accumulated in the capacitor in a unit period, a possible printing amount, for which power can be supplied, can be set. Accordingly, the size of the block for counting the number of the printing dots has to be determined so that a power consumption for printing all dots in the block is smaller than a capacity of the capacitor.

When the capacitor having large capacity is employed, the size of the block can be large to shorten a computing period for dot counting. On the other hand, when the capacitor having small capacity is employed or the head of a large number of ejection openings are used, it becomes necessary to make a lateral width of the block smaller. Preferably, it is desirable to set the size of the block in the extent that a printing speed is not affected by the computing period. The present invention, however, may be applied to a system of any size of the block. In the extreme example, even with the capacitor having a capacity, with which simultaneous driving of all ejection opening even in one longitudinal column, the present invention is effectively applicable by setting the lateral width of the unit counting block to one.

At every scan, the shown process is executed. At first, at step S300, a counting block in question is set as n=1, l=1, and a memory region, such as a register or the like, for storing values $S_1$ to $S_L$ is initialized.

At step S301, the number of data "1" in the counting block in question as identified by the values of n and l is counted to derive the number of driving $r_{ln}$ of the counting block. Next, at step S302, $r_{ln}$ derived as set forth above is added to the value $S_l$ to store the sum as the new value of $S_l$ in the corresponding memory region. Also, at step S303, judgment is made whether the value $S_1$ does not exceed the upper limit value R.

Here, if $S_l$<R, the value of l is incremented by one to shift the process to next counting block in the direction of printing scan. Thus, for all of l (1 to L), the process for checking whether the corresponding $S_l$ satisfies $S_l$<R or not.

On the other hand, when it is confirmed that $S_l$<R is established for all of l (1 to L), n is incremented by one at step S306 for performing counting of the number of driving $r_{ln}$ for l=1 to L, calculation of $S_l$ and comparison of $S_l$ with R in sequential order in the same manner as above, for the next longitudinal block. These processes are repeated until n>N is detected at step S307.

While the process for l=1 to L and n=1 to N is executed in sequential order, if $S_l$>R is found certain (l, n) (step S303), the counting process is interrupted and the process jumps to step S308. At step S308, for n at which the process is interrupted, printing of printing blocks of (n−1) in the number identified by 1 to (n−1) of the longitudinal block number, is performed. Namely, printing is performed for a corresponding region with the ejection openings and data corresponding to the 1 to (n−1)th counting blocks. When $S_l$<R is satisfied in all of the counting blocks up to n=N, printing is performed using all of the ejection openings for N in number of counting blocks. After printing at step S308, at step S309, paper feeding for (n−1) of counting blocks, namely for a printed region, is performed.

Figure 7:
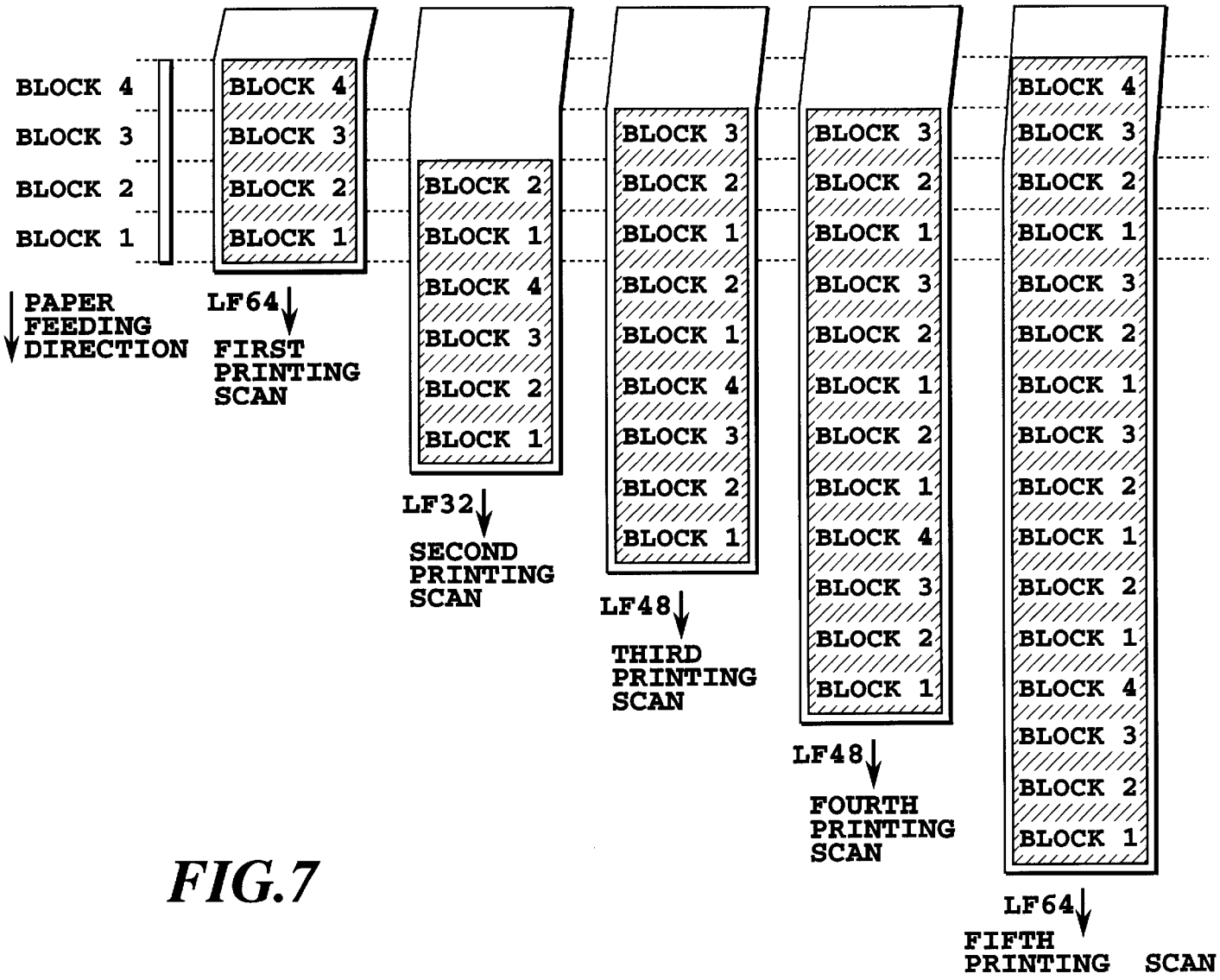
FIG. 7 is an illustration diagrammatically illustrating an example of printing in the first embodiment.

FIG. 7 is a diagrammatic illustration showing an example of printing on a basis of the process shown in FIG. 6.

A first printing scan represents a case where $S_l$<R is satisfied up to n=N. Namely, for all four blocks, scanning for printing using all of sixty-four ejection openings is performed, and thereafter, paper feeding for sixty-four ejection openings is performed. A second printing scan represents a case where $S_3$>R is detected at certain value of l where n=3. In this case, printing is performed for only first and second blocks using thirty-two ejection openings, and subsequently, paper feeding for thirty-two ejection openings is performed. A third and a fourth printing scans represent a case where $S_4$>R is established at certain value of l in n=4. In this case, printing is performed for three blocks of the first, second and third blocks using forty-eight ejection openings, and subsequently, paper feeding for forty-eight ejection openings is performed. A fifth printing scan represents a case where all four blocks are printed.

Figures 1A, 1B, 1C:
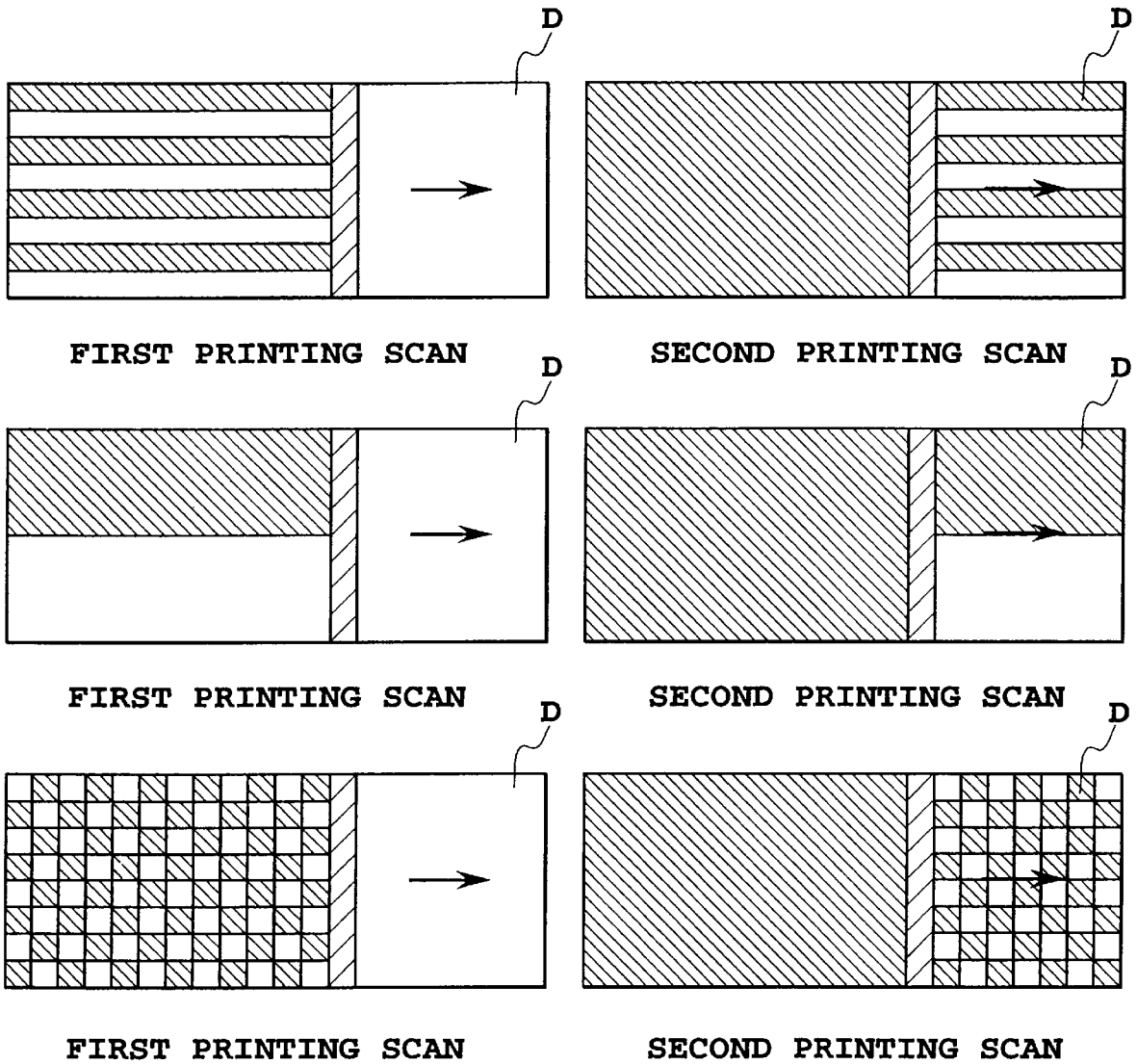
FIG.1A PRIOR ART
FIG.1B PRIOR ART
FIG.1C PRIOR ART
FIGS. 1A to 1C are explanatory illustrations of various conventional power saving printing methods.
Figure 2:
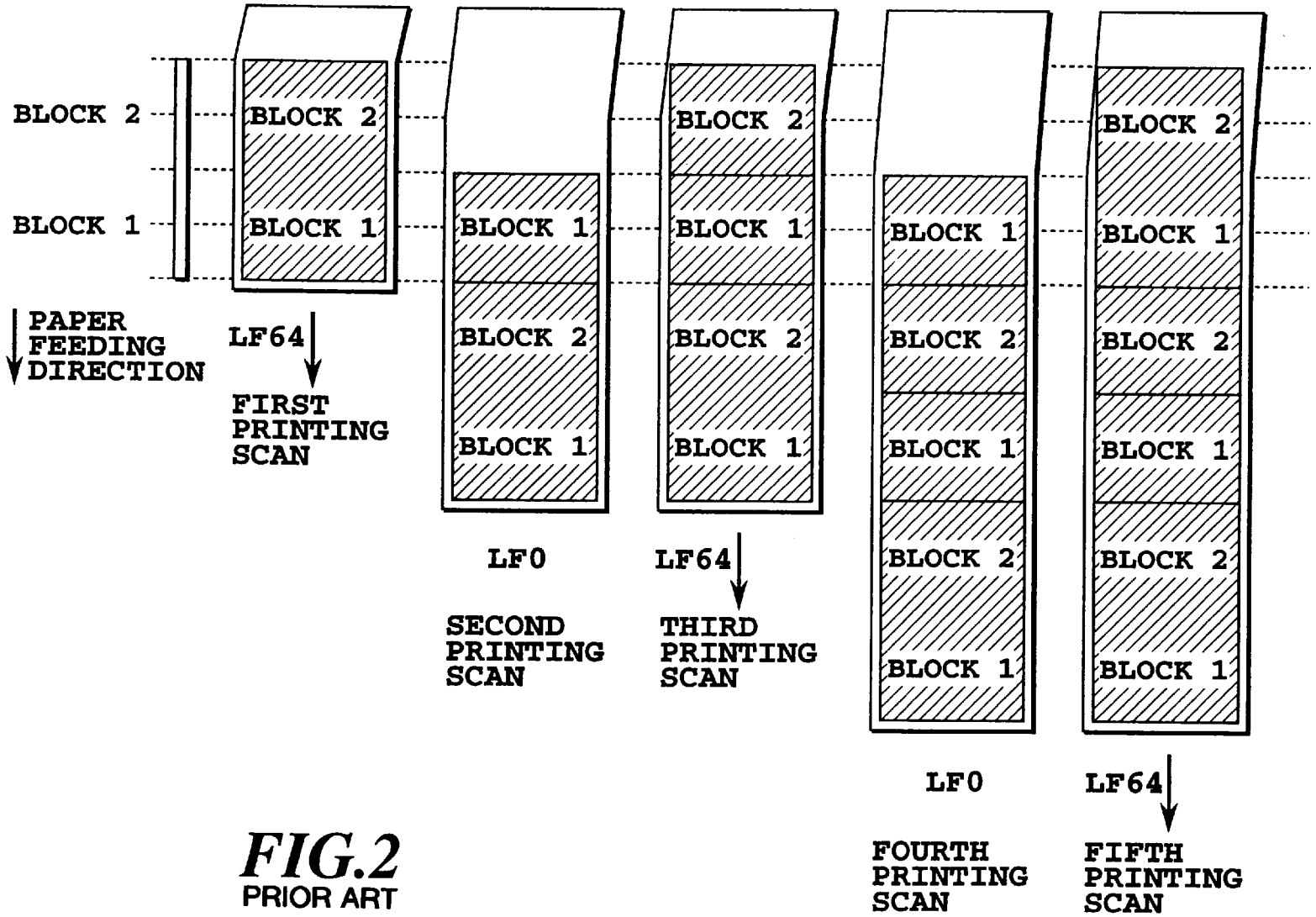
FIG.2 PRIOR ART
FIG. 2 is an illustration showing an example of printing in a conventional power saving mode.

Comparing an example of printing in the shown embodiment as illustrated in FIG. 7 and an example of the prior art shown in FIG. 2, in the prior art shown in FIG. 2, whenever printing cannot be performed by using all of the ejection openings, alternate printing for the first and second blocks is used constantly, and paper feeding is not performed between printing of the first and second blocks. Namely, in the case of the prior art shown in FIG. 2, even when the power source capacity permits printing for forty-eight ejection openings (three blocks of FIG. 7), printing is performed with merely thirty-two ejection openings. In contrast, in the shown embodiment, printing for forty-eight ejection openings can be performed in accordance with the power source capacity as in the third and fourth printing scan in FIG. 7. Such difference of twelve ejection openings per one scan becomes significant in the sizes of the image region at completion of printing as can be clear from comparison up to fifth printing scans of FIG. 7 and FIG. 2. The difference clearly increases according to increasing of the printing amount to one page, several pages.

As set forth above, with the shown embodiment, number of ejection openings to be driven at each printing scan can be determined depending upon density of the driving data and the density distribution by dividing the printing data in the alignment direction of the ejection openings and in the printing scan direction into a plurality of blocks and counting number of drive data per each of these counting blocks. By this, printing with maximizing use of the power source capacity and minimizing lowering of the throughput can be realized.

(Second Embodiment)

In the foregoing first embodiment, all of the ejection openings are divided into a plurality of blocks for determining the number of ejection openings to be actually driven per block. In contrast to this, in the shown embodiment, the number of ejection openings to be used for actual printing is determined under the condition where the number of division of the blocks in the longitudinal direction is maximized, namely is determined per unit of one ejection opening. It should be noted that the shown embodiment will be explained in terms of a monochrome printer using the head having sixty-four ejection openings, similarly to the foregoing first embodiment.

Figure 8:
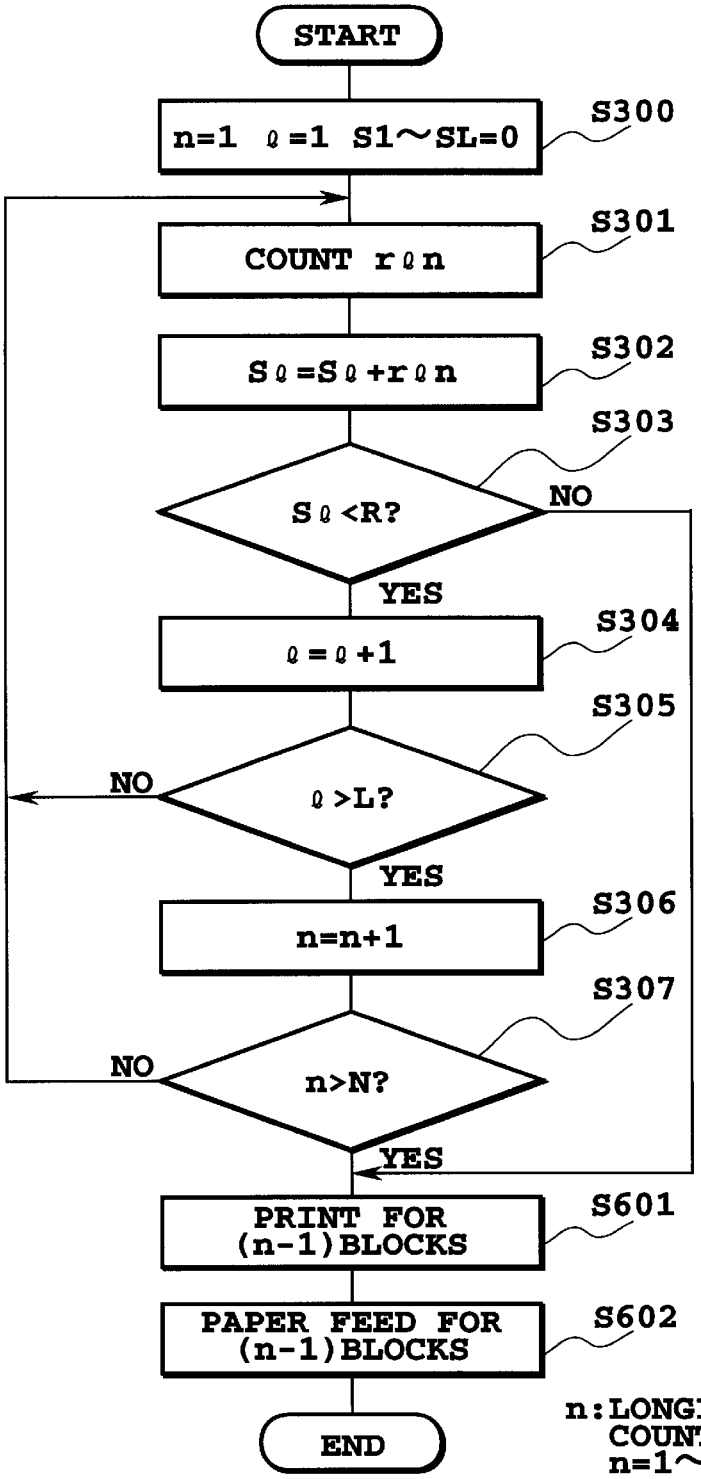
FIG. 8 is a flowchart showing a process and so on for determining number of the ejection openings to be driven in a second embodiment of the present invention.

FIG. 8 is a flowchart showing a major process for determining number of ejection openings to be actually printed in the shown embodiment. Here, N=64, division in the lateral direction is the same as the first embodiment, namely L=15. In the process shown in FIG. 8, the processes at steps S301 to S305 are the same as those represented by the same reference signs in the first embodiment. Further, the increment at step S306 becomes a unit of one ejection opening. The process is controlled so that the routine of steps S301 to S307 is repeated until n>N=64.

During the process set forth above, when $S_l$>R is detected at certain (n, l), the counting process is interrupted to perform printing for the corresponding region with the ejection opening and data of 1 to (n−1)th (step S601). It should be noted when $S_l$<R is continuously satisfied up to n=N, printing is performed with all of sixth-four ejection openings. Subsequently, paper feeding for the (n−1) (printed region) is performed (step S602).

As set forth above, in contrast to the first embodiment, in which number of ejection openings to be actually used for printing is determined per sixteen ejection openings of one block, the shown embodiment may set per one ejection opening. Therefore, the number of actual driving can be further closer to the upper limit R of the power supply. As a result, it becomes possible to further efficiently use the power source capacity than that in the first embodiment.

It should be noted that, in the shown embodiment, number of repetition of the process of steps S301 to S307 becomes greater to possibly cause prolong process period for determining the number of ejection openings to be driven. However, if this process can be completed during a period, in which the carriage returns to the home position for the next scan or during paper feeding, the shown embodiment may be effective.

When it is not possible to complete the foregoing determination process during returning operation of the carriage or the like, number of division for the blocks in the alignment direction of the ejection openings may be determined in view of the power source capacity, the driving frequency, data transfer period and so on set for the printing apparatus.

(Third Embodiment)

In the third embodiment, the present invention is applied for a full-color printer employing heads respectively ejecting inks of yellow, magenta, cyan and black.

Figure 9:
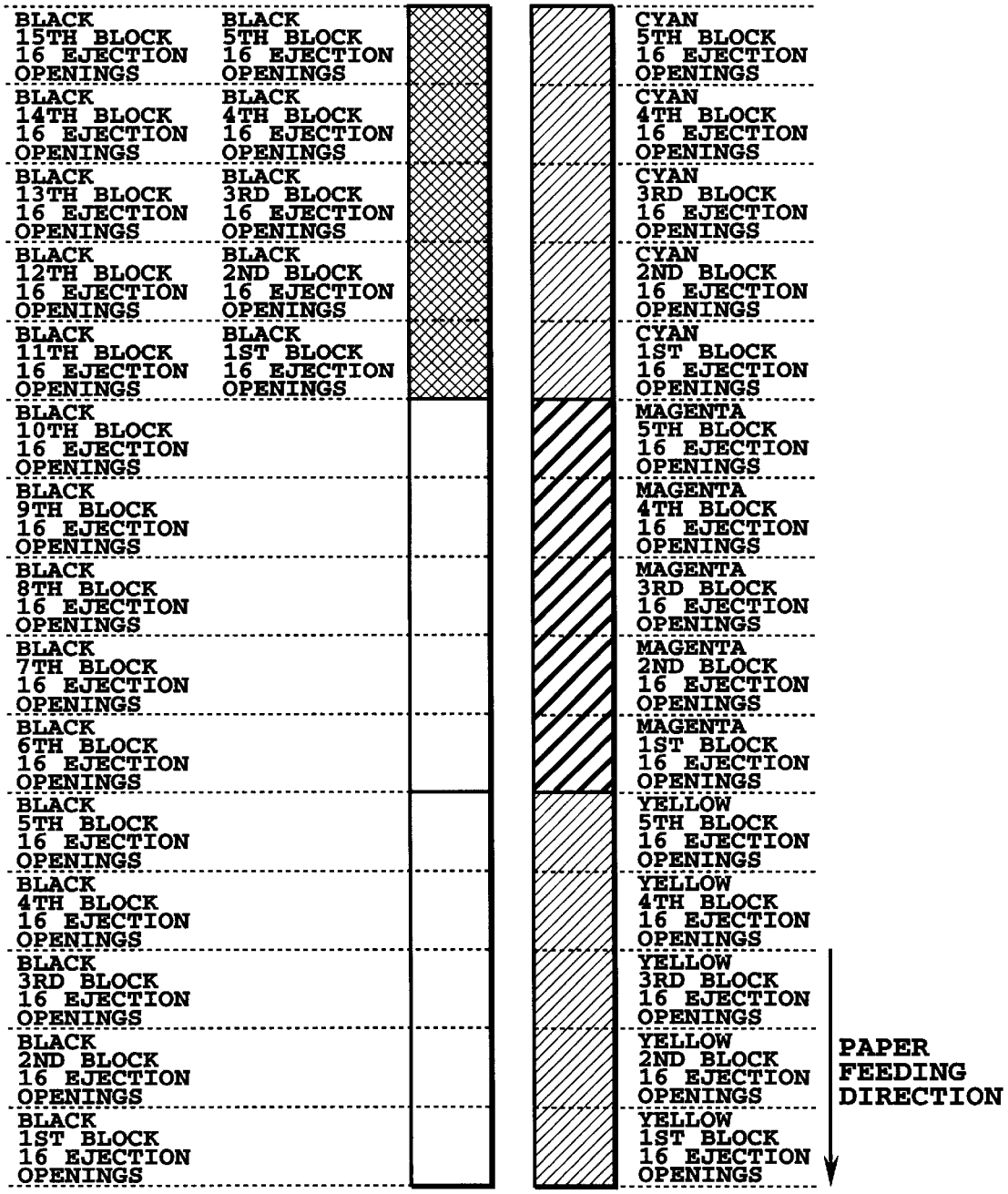
FIG. 9 is an illustration showing a construction of a third embodiment of the head and its ejection openings in the present invention.

FIG. 9 is a diagrammatic illustration of the head to be employed in the shown embodiment.

A head ejecting the back ink (hereinafter simply referred to as a black head) and a head for ejecting color inks of yellow, magenta and cyan (hereinafter simply referred to as a color head) are arranged in a direction of printing scan. A pitch of ejection openings in each head corresponds to 600 dpi of resolution of printing. The black head has two-hundreds forty ejection openings and the color head has eighty ejection opens arranged in the paper feeding direction for each of colors of yellow, magenta and cyan. Respective eighty ejection openings for respective colors are integrated in a single head. In both of the black head and the color head, sixteen ejection openings are corresponded to one block. Accordingly, the ejection openings in the black head are divided into fifteen blocks and the ejection openings in the color head are divided into respective five blocks for respective colors, for counting numbers of driving.

When the head shown in FIG. 9 is employed, upon printing of a color image, eighty ejection openings of the black head arranged at the corresponding positions of the ejection openings for cyan in parallel relationship (the ejection openings located within a region shown by cross hatching in FIG. 9) are used for printing. Concerning the color inks, printing scan using corresponding eighty ejection openings and paper feeding are alternately performed for overlaying respective colors in the sequential order of black+cyan→magenta→yellow to complete the image. On the other hand, in a case of the image, in which a black image is partially continuous and the color inks are not used as in a character region, the number of the ejection openings to be used in the black head may be increased as much as possible to speed up printing.

Figures 10A, 10B:
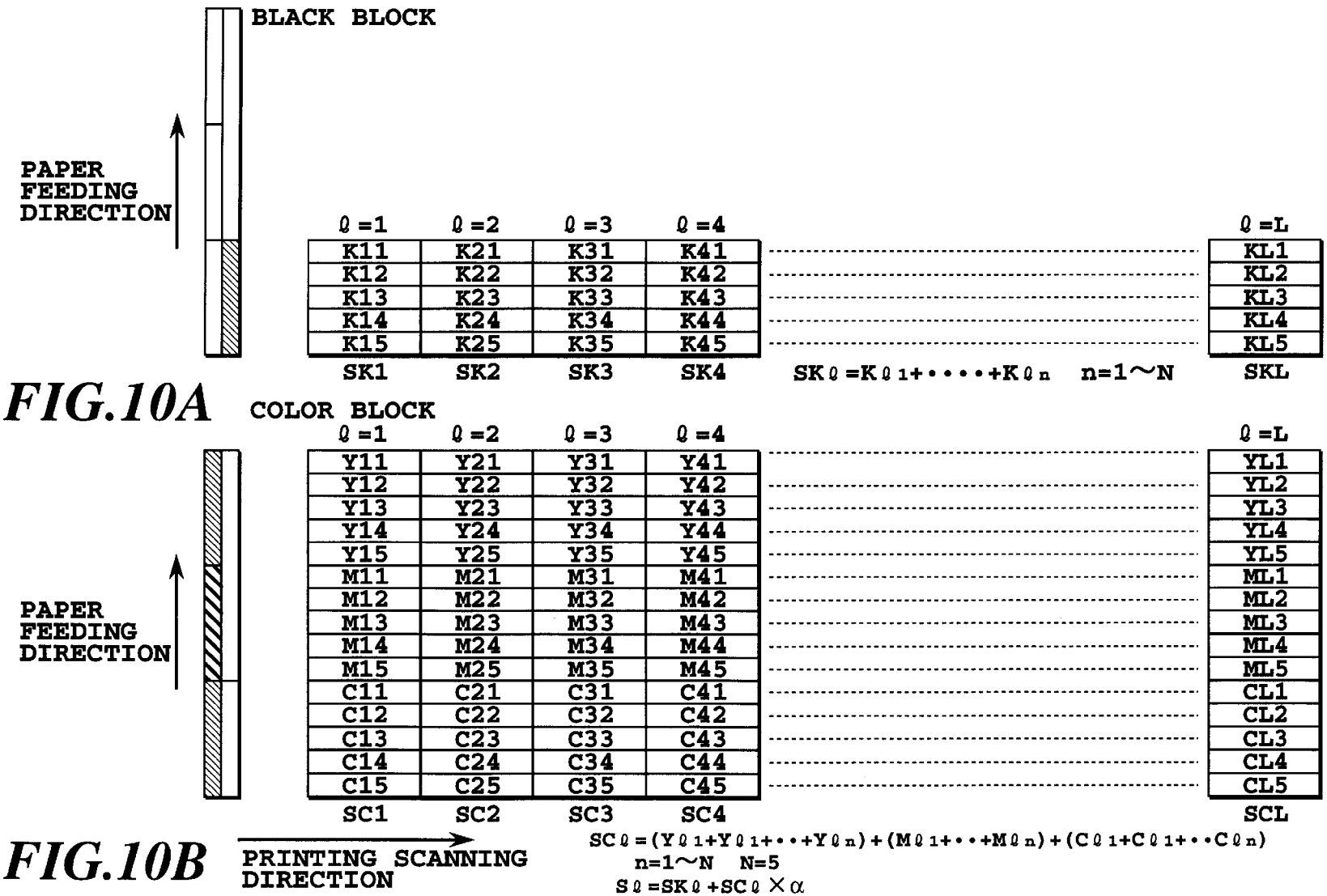
FIGS. 10A and 10B are illustrations for explaining principle of a counting block for counting number of times of driving in the third embodiment.

FIGS. 10A and 10B are conceptual illustrations of counting blocks for counting the number of printing dots in the shown embodiment.

Also in the shown embodiment, similarly to the first embodiment, one counting block is consisted of longitudinal sixteen pixels×lateral three-hundreds twenty pixels. The black head is divided into longitudinal fifteen blocks and the color head is divided into longitudinal five blocks for each color and thus fifteen blocks in total. $K_{ln}$, $Y_{ln}$, $M_{ln}$ and $C_{ln}$ are number of driving (number of printing dots) of each color and in each block. Further, $SK_l$ is a sum of the number of driving of the black head from $K_{l1}$ to $K_{ln}$, and $SC_l$ is a sum of the number of driving of each color (in case of cyan, from $C_{l1}$ to $C_{ln}$; in case of magenta, from $M_{l1}$ to $M_{ln}$; and in case of yellow, from $Y_{l1}$ to $Y_{ln}$).

A number of driving R taken as the upper limit in the former embodiment, has to be compared with the sum of the number of driving of all colors, in the shown embodiment. In this case, if a power consumption per driving for ejection at one time (one printing dot) is the same in both of the color head and the black head, the number of driving may be simply summed. However, if the power consumption of the color head per one dot is $\alpha$ times of that of the black head, it becomes necessary to sum the number of driving of the color head multiplied by $\alpha$ with the number of driving of the black head. The number of driving thus obtained finally is taken as $S_l$. It should be noted that the value R in the shown embodiment has to be a value, at which the power source capacity may be sufficient even when data for at least one counting block all represent ejection "1" for all colors. In addition, a difference of the power consumption between the color head and the black head set forth above is due to differentiating ejection energy for differentiating an ejected amount of the ink between the color and the black heads.

Figure 11:
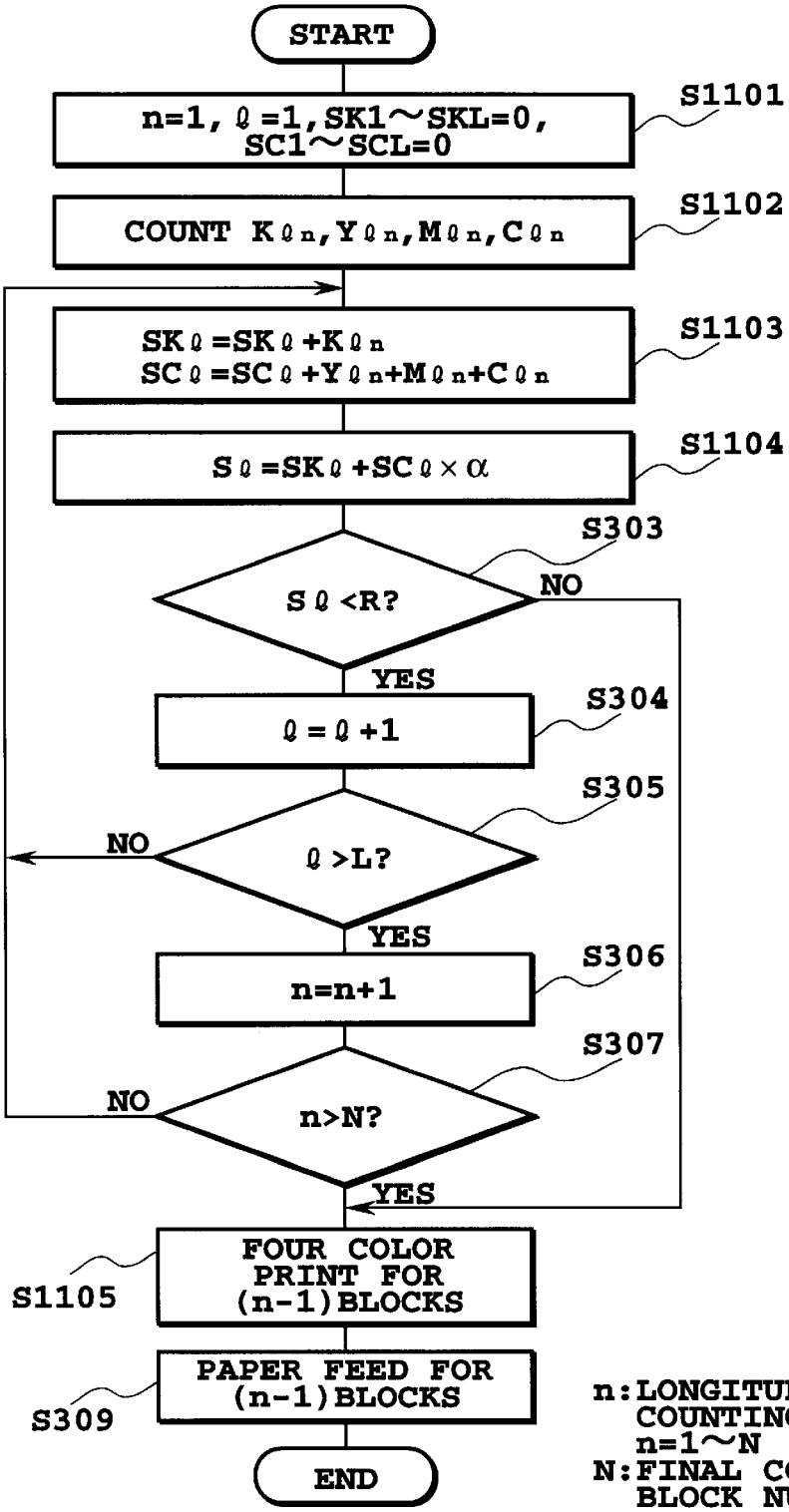
FIG. 11 is a flowchart showing a process and so on for determining number of ejection opening to be driven in the third embodiment.

FIG. 11 is a flowchart showing a process for determining the number of printing block per each scan in the shown embodiment.

At first, the objective counting block for the process is set n=l=1 for all colors, at step S1101. Further, the memory regions for respective of $SK_1$ to $SK_L$ and $SC_1$ to $SC_L$ are initialized.

At step S1102, among a driving data corresponding to the counting block identified by the values l and n, number of data indicative of ejection "1" is counted for each color to take number of driving in the objective counting block as $K_{ln}$, $Y_{ln}$, $M_{ln}$ and $C_{ln}$. Further, at step S1103, $K_{ln}$ thus derived at step S1102 is added to $SK_l$ to derive new $SK_l$. Similarly, for the color head, $Y_{ln}$, $M_{ln}$ and $C_{ln}$ are added to $SC_l$ for deriving new $SC_l$.

The consumed power per one dot of the color head is assumed to be $\alpha$ times of that of the black head, in the shown embodiment. At step S1104, the final number of driving is calculated from $S_l=SK_l+SC_l\times\alpha$. The subsequent processes are similar to those of the foregoing first and the second embodiments, and thus l and n are incremented and comparison of $S_l$ and R is performed (steps S303 to S307).

While the foregoing routine is executed, when $S_l>R$ is established at certain l, n, the counting is stopped or interrupted to perform printing for the corresponding region with employing the ejection openings corresponding to the counting blocks of first to (n−1)th. It should be noted that $S_l<R$ is continuously satisfied up to n=N (=5), ejection is performed with N blocks, namely all of ejection openings of the color head and eighty ejection openings of the black head. Subsequently, paper feeding for (n−1) blocks (for the printed region) is performed.

The foregoing is the counting method for the region where a color image and a black image are present in one page in admixing manner. As set forth above, even in the shown embodiment, in the region where the black image is locally continuous and only black head is driven, the mode may be automatically switched into the mode the same as that of the first embodiment, instead of the foregoing counting mode. In this case, so that all two-hundred forty ejection openings may be effectively used as much as possible, a position of the leading block and number of all blocks may be switched. Then, according to the flowchart shown in FIG. 6, the number of ejection openings to be used in each printing scan is determined.

Figure 12:
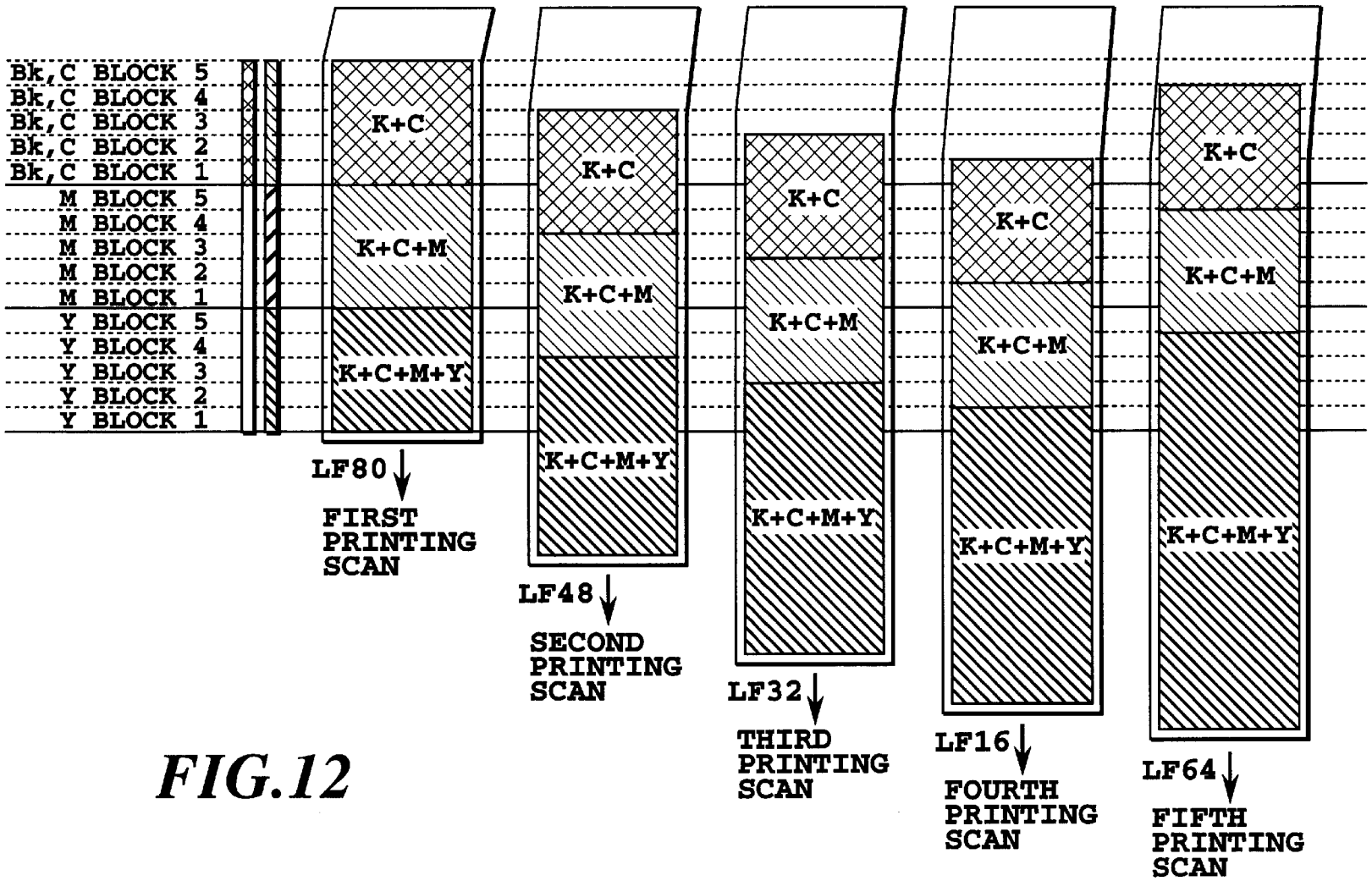
FIG. 12 is an illustration diagrammatically showing an example of printing in the third embodiment.

FIG. 12 is a diagrammatic illustration showing an example of printing on a basis of the process shown in FIG. 11 as set forth above.

In the example shown in FIG. 12, at least twice of printing scan is performed before a first printing scan. In the shown example, in the printing region for the ejection openings of Y and the printing region for the ejection openings of M, the images of K+C or M are already printed.

The first scan represents the case where driving is possible for all of the blocks. Namely, printing of five blocks is performed for respective of black, cyan, magenta and yellow (with respective eighty ejection openings), and paper feeding is performed for five blocks (for eighty ejection openings).

A second scan represents a case where printing for three blocks is performed. Namely, after performing printing for the first to third blocks (forty-eight ejection openings) of respective colors, paper feeding for forty-right ejection openings is performed. A third scan represents a case where printing for two blocks is performed. Namely, after performing printing for the first to second blocks (thirty-two ejection openings) of respective colors, paper feeding for thirty-two ejection openings is performed. A fourth scan represents a case where printing for only one block is performed. Namely, after performing printing for the first block (sixteen ejection openings) of respective colors, paper feeding for sixteen ejection openings is performed. Further, a fifth scan represents a case where printing for four blocks is performed. Namely, after performing printing for the first to fourth blocks (sixty-four ejection openings) of respective colors, paper feeding for sixty-four ejection openings ejection openings is performed.

As set forth above, by the shown embodiment, in the color ink-jet printing apparatus, similarly to the foregoing embodiments, limited power source capacity can be effectively used to realize printing with restricting lowering of throughput.

(Fourth Embodiment)

The shown embodiment represents a case where dividing printing is performed by using only black head similarly to the first embodiment. Hereinafter, a dividing printing method of the shown embodiment will be explained briefly.

Figure 13C:
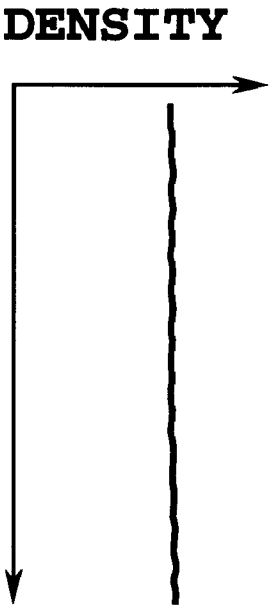
FIGS. 13A to 13C are explanatory illustrations for explaining ejection characteristics, such as ejection amount and the like in each ejection opening in the head.
Figure 13B:
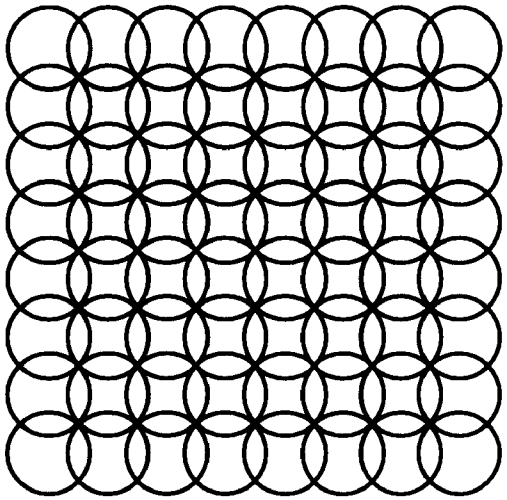
Figure 13A:
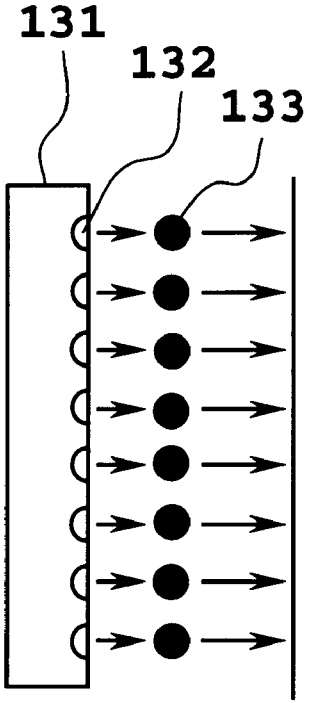

FIG. 13A is an explanatory illustration of a distribution of an ink ejection amount or the like in the printing head 131. A printing head 131 is shown in a construction consisted of eight ejection openings 132 for simplification of discussion. In FIG. 13A, a reference numeral 133 denotes an ink droplet to be ejected through the ejection opening 132. In general, as shown in FIG. 13A, it is ideal to eject the ink in uniform ejection amount and in a same direction. Namely, by performing such ejection, dots having the uniform size are formed on a paper surface, as shown in FIG. 13B and thus can obtain a uniform image density fluctuation over the entire region (FIG. 13C).

However, in practice, there is fluctuation in an ejection amount or the like in respective ejection openings. Therefore, if printing is performed in the same manner as that set forth above, sizes and directions of the ink droplets to be ejected from respective ejection openings may be fluctuated as shown in FIG. 14A, for example, to form the dots on the paper surface, as shown in FIG. 14B. When such fluctuation is present, it is possible to periodically form a blank portion where an area factor of 100% cannot be satisfied with respect to a primary scanning direction, and conversely, unnecessarily overlap the dots, or a white stripe is formed as seen at the center in FIG. 14B. An image printed in such condition should have density distribution as shown in FIG. 14C resulting in perception of density fluctuation.

Figure 16A:
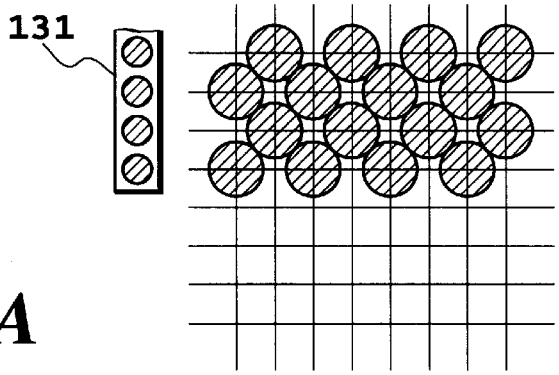
FIGS. 16A to 16C are illustrations showing one example of thinning of an image data in the divided printing method.
Figure 16B:
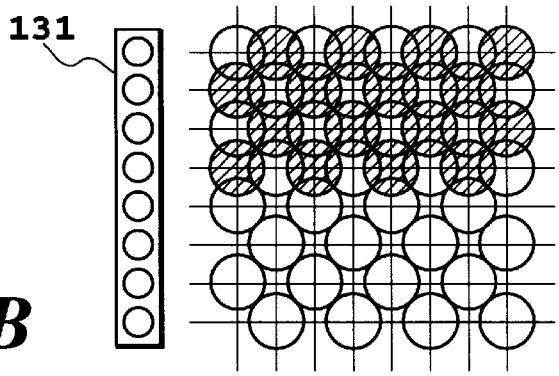
Figure 16C:
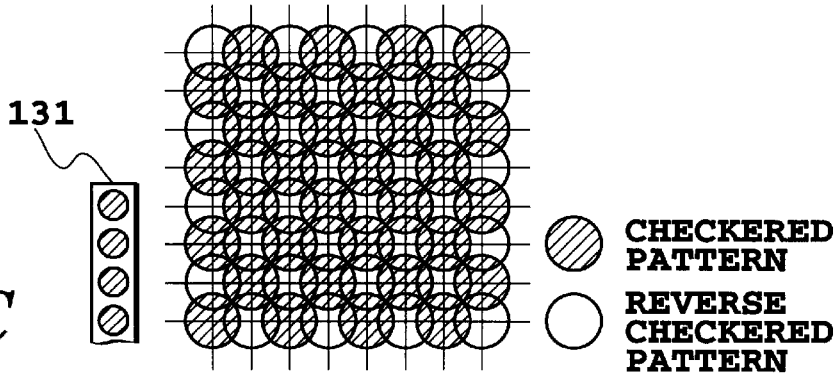

As the following measure for such density fluctuation has been conventionally proposed. With this method, for completing printing of the printing regions shown in FIG. 13B or FIG. 14B, scanning is performed for three times with the head 131. In this case, the eight ejection openings of the head 131 are divided into groups of upper four ejection openings and lower four ejection openings. Dots printed by one scan with one ejection opening are that which are derived by thinning the image data as shown in FIGS. 16A and 16B into about half according to a predetermined image data arrangement. Then, in a second printing scan, remaining half of the printing data is printed to complete printing for the region of four pixels in the paper feeding direction. Such printing method is referred to as the dividing printing method in this specification.

Figure 14C:
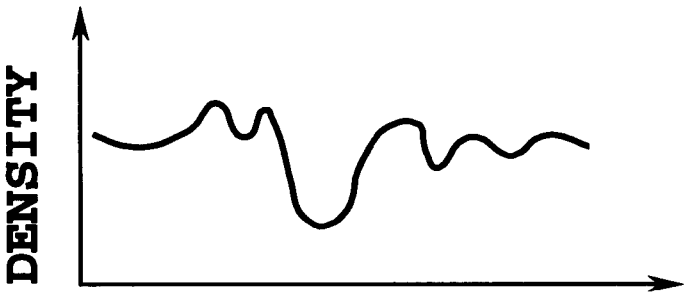
FIGS. 14A to 14C are illustrations for explaining a case where fluctuation is present in the ejection characteristics.
Figure 14B:
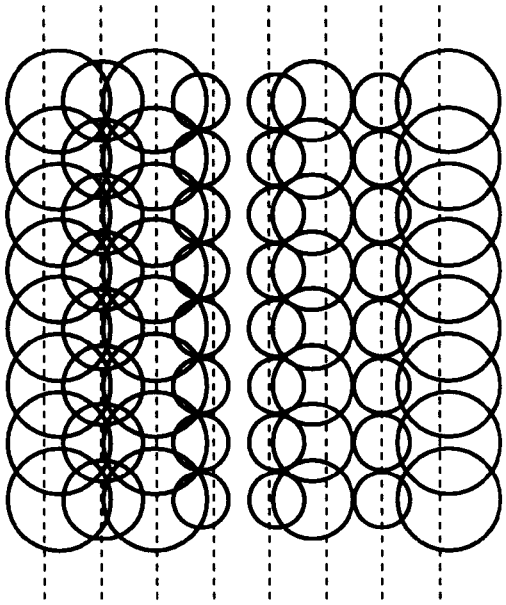
Figure 14A:
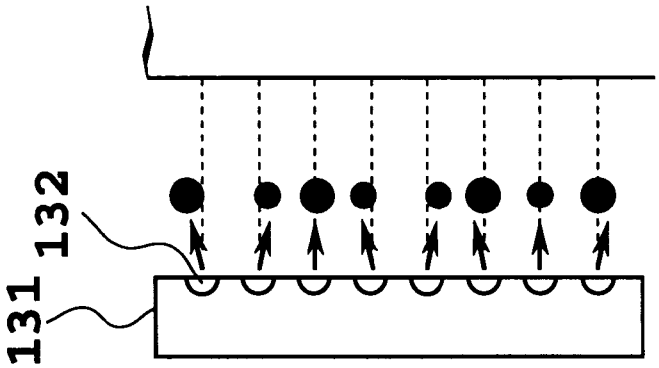
Figures 15A, 15B, 15C:
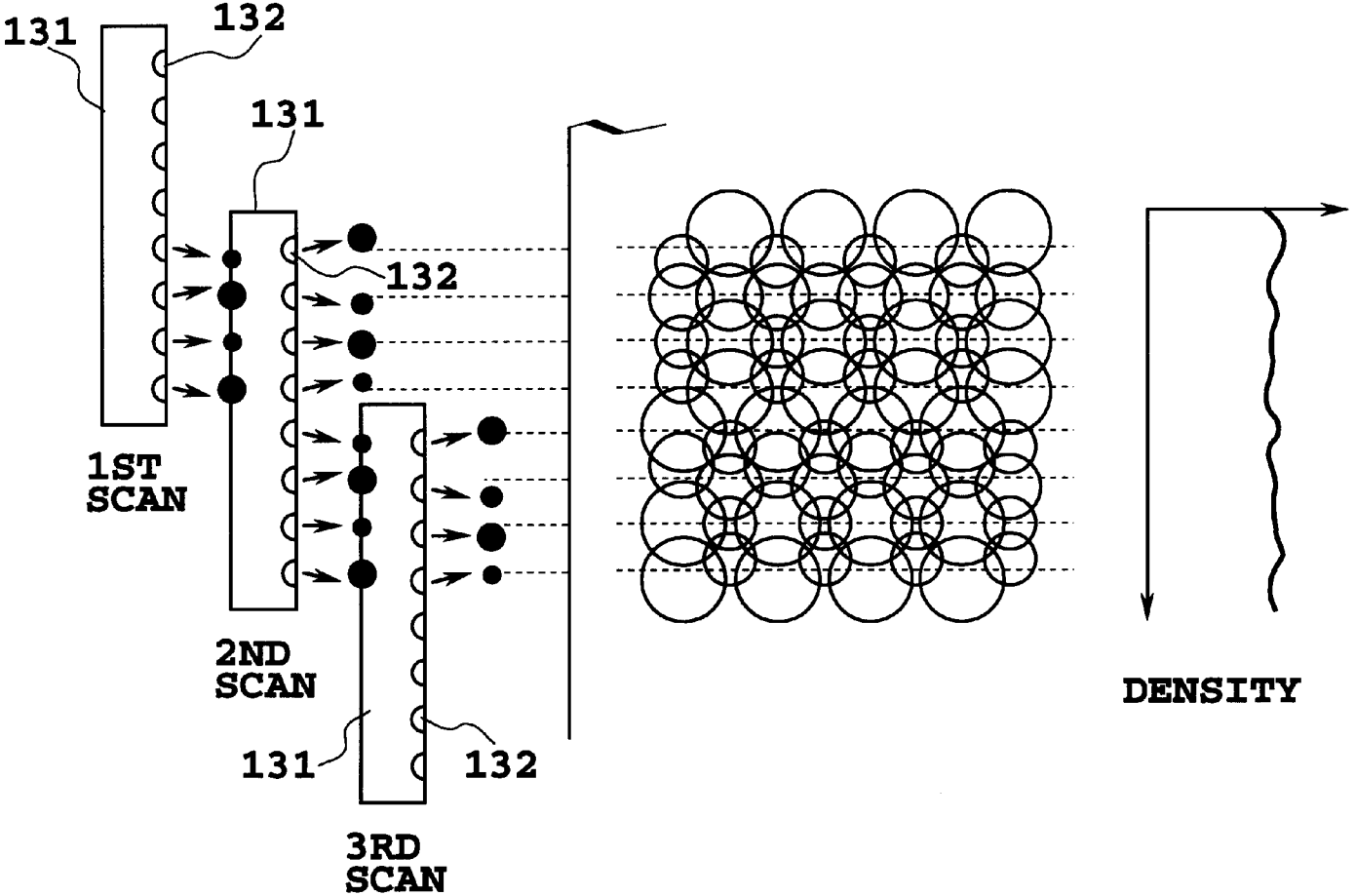
FIG. 15A to 15C are illustrations for explaining divided printing method for lowering fluctuation in the ejection characteristics.

With employing such printing method, even when the head having non-uniformity in the ejection amount or the like as shown in FIGS. 14A to 14C, influence of the ejection characteristics unique for each ejection opening can be reduced to be half. Thus, the printed image becomes as illustrated in FIG. 15B to make the black stripe or white stripe shown in FIG. 14B not perceptible. Accordingly, the density fluctuation can also be reduced as shown in FIG. 15C in comparison with that shown in FIG. 14C. Therefore, this is particularly effective in a case where uniformity of half tone is required such as for graphic image.

In the shown embodiment, the foregoing dividing printing method employing the head shown in FIG. 3, is performed.

Figure 17:
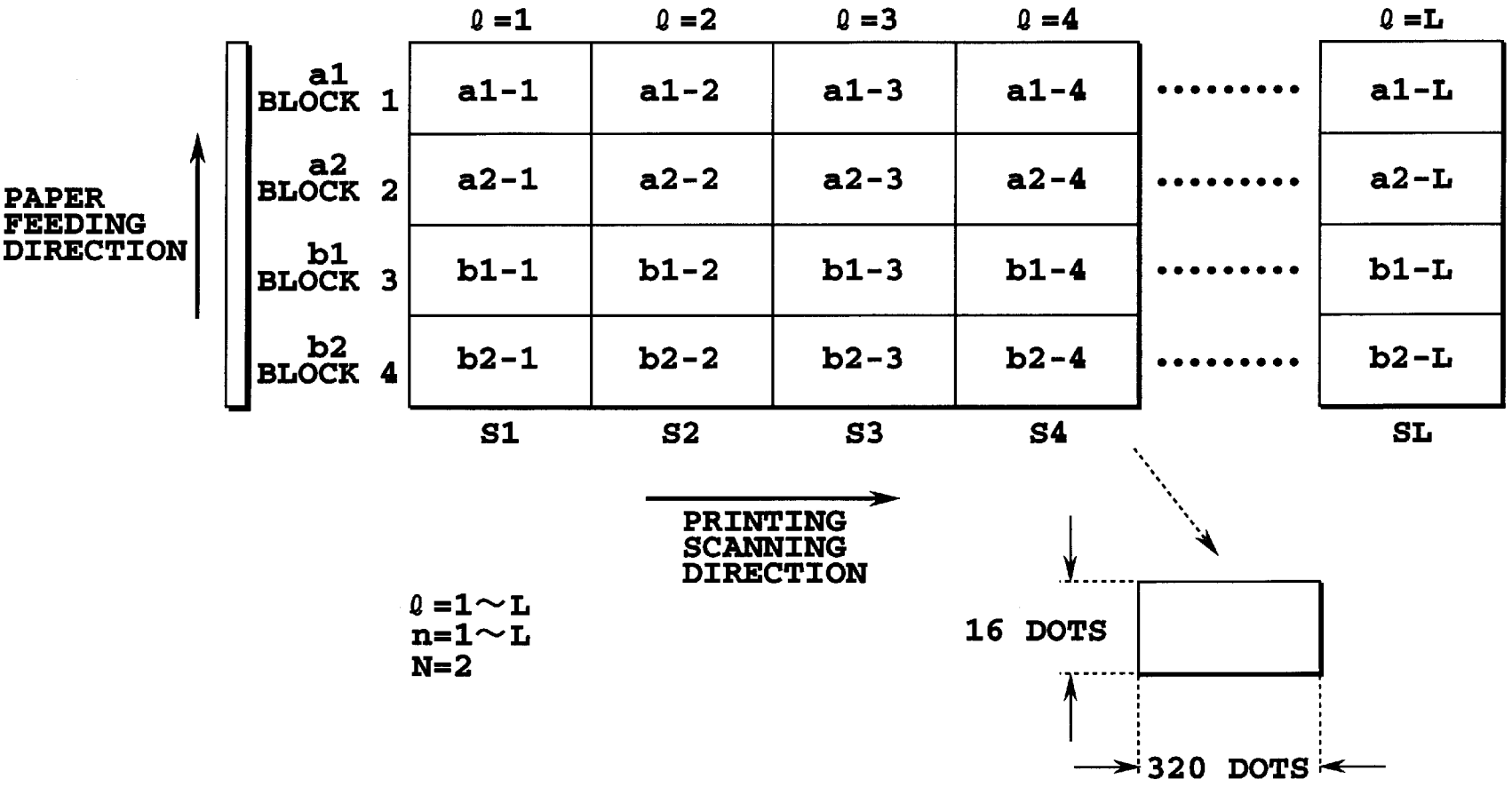
FIG. 17 is an illustration showing a construion of a fourth embodiment of a head and its ejection opening block according to the present invention.

FIG. 17 is an illustration for explaining a principle of the counting the block for counting number of the printing dots, in the shown embodiment.

Also in the shown embodiment, similarly to the foregoing embodiments, longitudinal sixteen pixels×lateral three-hundreds twenty pixels are taken as one counting block. For all of the ejection openings of the head, the ejection openings are divided into four blocks in the longitudinal direction. Since the shown embodiment performs the foregoing dividing printing, "a" region (a1 region corresponding to a block 1 and a2 region corresponding to a block 2) and "b" region (b1 region corresponding to a block 3 and b2 region corresponding to a block 4) are normally complementary of each other to complete the image. $a_{n-l}$ and $b_{n-l}$ are number of driving to be counted in one counting block. $S_l$ is a sum obtained by adding the number of driving of the black head by a predetermined method described later.

In the shown embodiment, the number of a driving block for the a region and the number of a driving block for the b region are constantly the same, and the paper feeding amount is determined according to the width of the number of the driving blocks in each regions.

Figure 18:
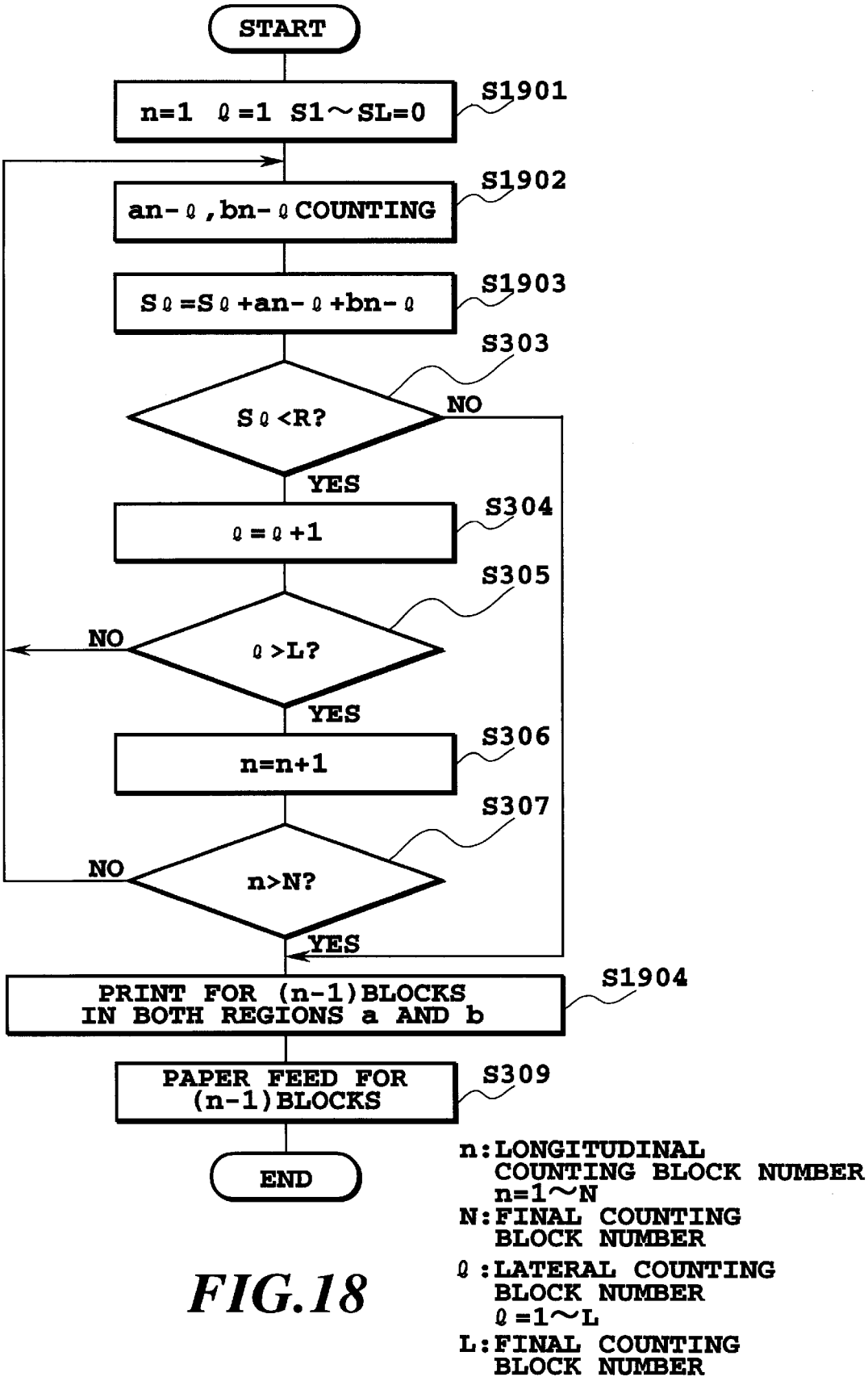
FIG. 18 is a flowchart showing a process for determining number of ejection openings to be driven in the fourth embodiment.

A flowchart of the process for determining the number of the driving blocks per each scan and so on, in the shown embodiment, is shown in FIG. 18.

At first, in the initializing process at step S1901, values n and l identifying the objective block to be processed are set to 1, and respective memory regions for $S_1$ to $S_L$ are initialized.

At step 1902, among data in the counting block identified by the values of n and l, number of data indicative of ejection "1" is counted per regions a and b to take as number of driving (number of printing dots) $a_{n-l}$, $b_{n-l}$ of respective blocks. Furthermore, at step S1903, $a_{n-l}$ and $b_{n-l}$ are added to $S_l$ to derive new $S_l$. The subsequent process is the same as those in the first and second embodiments to enter a routine to increment of l and n and comparing of $S_l$ with R (steps S303 to S307).

In the comparison routine, when $S_l$>R is judged, the counting process is terminated or interrupted and printing for the corresponding region is completed using the ejection openings corresponding to respective regions a and b identified the longitudinal block numbers by 1 to (n−1), and the data therefor (step S1904). Further, when $S_l$<R is continuously satisfied up to n=N (=2), printing for N blocks is performed. Subsequently, paper feeding is performed for (n−1) blocks (printed region) (step S309).

Figure 19:
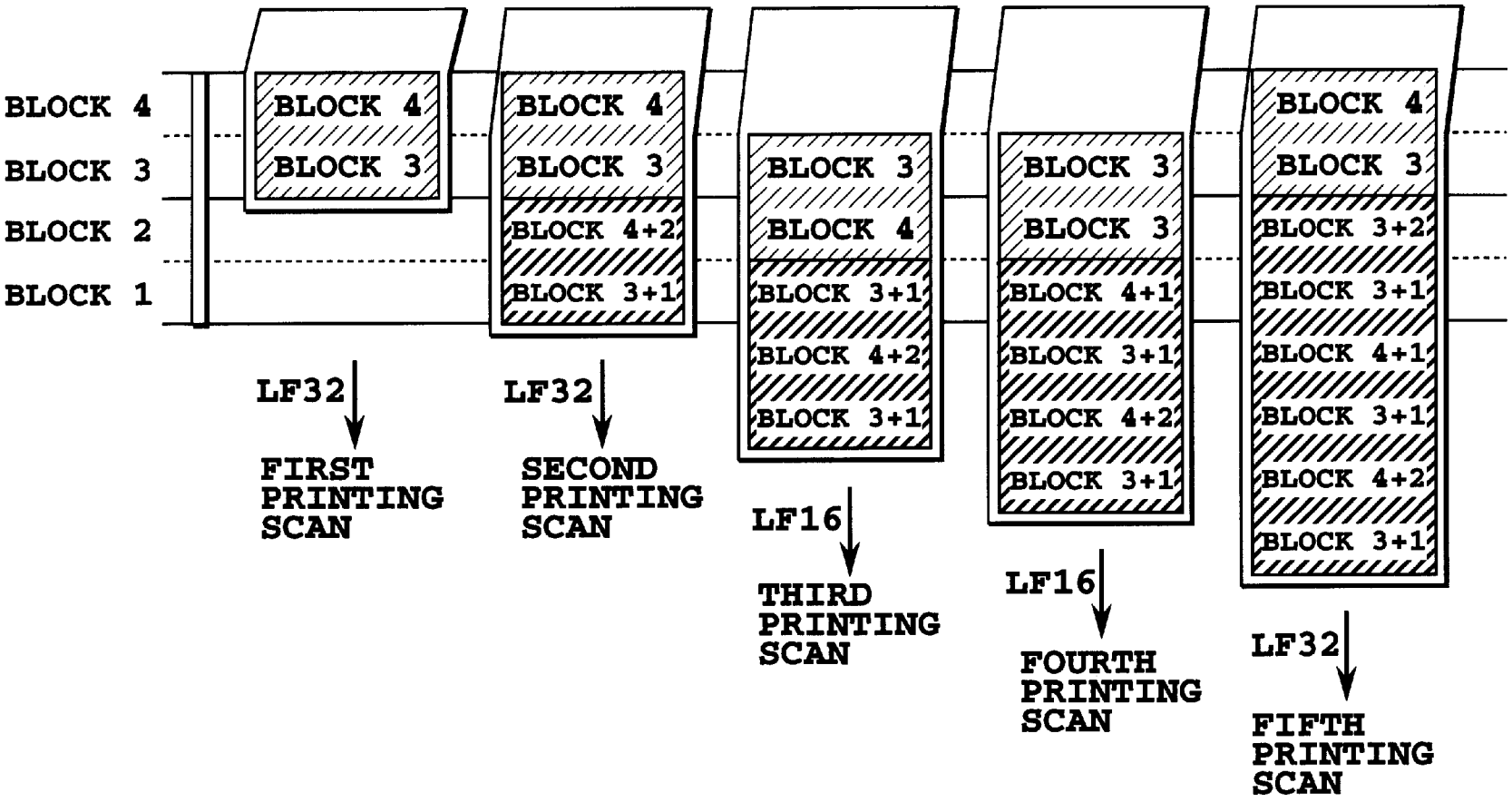
FIG. 19 is an illustration for showing an example of printing in the fourth embodiment.

An example of printing on the basis of the foregoing process in the shown embodiment is shown in FIG. 19.

A first printing scan is the first printing scan of the dividing printing method, in which image thinned into half of the real image is printed using only the ejection openings of the blocks 3 and 4. Subsequently, paper feeding for two blocks is performed. For the region, where 50% image is completed in the first printing scan, remaining 50% image is printed by the ejection openings of the blocks 1 and 2 to complete the image. In conjunction therewith, 50% region is formed using the ejection openings of the blocks 3 and 4 for new region. Subsequently, similarly to the first printing scan, paper feeding for two blocks is performed. Up to here, there is shown a condition where the dividing printing method is normally operated, in which driving of all blocks becomes possible through the process shown in FIG. 18.

A third printing scan shows printing in a case where $S_l$<R is satisfied for one block (n=1), but is not satisfied for two blocks (n=2). After printing using the sixteen ejection openings for one block in both of the regions a and b, paper feeding for sixteen ejection opening is performed. A fourth printing scan also represents a case where printing is performed by only one block in each region. After the printing scan, paper feeding for sixteen ejection opening is performed. A fifth printing scan represents a case where printing with two blocks in both regions is possible.

By repeating printing scan and paper feeding, a uniform and smooth output image can be obtained by dividing printing for any printing data having any printing density distribution.

In the shown embodiment, since the dividing printing is performed, the number of driving in each printing scan is reduced to be about 50% in comparison with that in the first embodiment. Accordingly, the power consumption in each printing scan can also be reduced. Thus, it is considered that the possibility of switching into the power saving mode in response to judgment of $S_l$<R can be low. However, in the case where the printing apparatus is used under a low temperature environment, in order to realize normal ejection, power consumption per one dot becomes large. Even in such case, with taking the construction of the shown embodiment, a stable image can be obtained constantly.

Furthermore, while the shown embodiment is constructed to constantly drive the same number of blocks in both of the regions a and b, even in the case where only one block can be driven, the printing scan for driving for printing in the region b and printing scan for driving for printing in the region a may be made independent of the other without performing paper feeding therebetween.

Furthermore, while description has been given for the head construction similar to the first embodiment, the shown embodiment is effective not only for the monochrome image but also for color image. Even with the color head as in the third embodiment, respective colors of heads are divided into regions a and b to calculate the sum of the number of driving for all eight regions to compare with the threshold value R to form the color image.

Furthermore, the foregoing description has been given in terms of the dividing printing method dividing the regions into two, i.e. regions a and b, the application of the present invention is not limited to this. In the dividing printing method, a greater number of division may obtain better image quality. The present invention is effective irrespective of the number of division in the dividing printing method. In this case, the number of block regions to be counted simultaneously may be increased corresponding to the number of division, such as region a, region b, region c, . . . For example, in a case of three dividing printing, $S_l=S_l+a_{n-l}+b_{n-l}+C_{n-l}$, and in a case of four dividing printing, $S_l=S_l+a_{n-l}+b_{n-l}+c_{n-l}+d_{n-l}$.

As set forth above, even in the ink-jet printing performing dividing printing in the shown embodiment, the limited power source can be effectively used within the power source capacity to realize printing with minimizing lowering of throughput.

The present invention achieves a distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

As set forth above, with respective embodiments of the present invention, the number of driving of the printing element in each scan is detected in association with the size of the partial region of the scanning region, to make the printing in scan of the number of the printing elements to be driven in scan corresponded to the partial region associated with detection of printing, and to perform paper feeding for the partial region when the detected value exceeds a predetermined value which can be determined depending upon the power source capacity of the apparatus. Therefore, with optimally using the power source capacity, the size of the printing region to be reduced by restriction of the capacity can be minimized.

As a result, the given power source capacity can be efficiently used as much as possible without significantly lower throughput.

In addition, since it is not necessary to vary a driving frequency of the head for each printing scan and to vary the number of the dividing printing for an image region within a page of the printing medium, printing of an image having no fluctuation of density is performed.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A printing apparatus performing printing based on printing data by using a printing head, in which a plurality of printing elements are arranged, with scanning the printing head with respect to a printing medium in a direction different from a direction of an arrangement of the printing elements, comprising:

driving means for driving the plurality of printing elements of the printing head;

transport means for transporting the printing medium;

restriction means for restricting a number of printing elements to be driven in one scanning of the printing head so that a number of times of driving of said plurality of printing elements driven by said driving means during said one scanning becomes less than a predetermined number; and transport control means for controlling transportation of the printing medium by said transport means after said one scanning of the printing head such that an amount of transportation is varied so as to correspond to the number of printing elements restricted by said restriction means in said one scanning.

2. A printing apparatus as claimed in claim 1, which further comprises:

detecting means for detecting the number of times of driving the printing elements in the printing head with sequentially varying a size of a partial region obtained by dividing a scanning region of said printing head in a direction of the arrangement of the printing elements; and judgment means for judging whether the number of times of driving detected by said detecting means is greater than the predetermined number, and wherein when said judgment means judges that said number of times of driving is greater than said predetermined number, said restriction means restricts the driving of the printing elements to only the driving of the printing elements corresponding to said partial region.

3. A printing apparatus as claimed in claim 2, wherein said detecting means divides said scanning region into a plurality of counting blocks in the direction of the arrangement of the plurality of printing elements and in a scanning direction, counts said number of times of driving per said counting block as said partial region, and detects a sum of number of driving of respective counting blocks in said direction of the arrangement as said number of times of driving the printing elements.

4. A printing apparatus as claimed in claim 3, wherein said detecting means sequentially repeats, in said direction of the arrangement, counting the number of times of driving per each block in sequential order of blocks arranged in said scanning direction, and said restriction means restricts a number of printing elements to be driven for a region up to one block ahead of the position in said arrangement direction of the block, about which the judgment that the number of times of driving is greater than the predetermined value is performed, as the partial region of the size relating to said detection.

5. A printing apparatus as claimed in claim 4, wherein said partial region is determined corresponding to the plurality of printing elements to be driven simultaneously.

6. A printing apparatus as claimed in claim 5, wherein said printing elements perform printing by ejecting an ink.

7. A printing apparatus as claimed in claim 6, wherein said printing head generates a bubble in the ink using thermal energy and performs ejection of the ink by a pressure of the bubble.

8. A printing apparatus as claimed in claim 6, wherein said printing head is a plurality of printing heads corresponding to different kinds of inks.

9. A printing apparatus as claimed in claim 1, wherein said transport means transports the printing medium for an amount less than an amount corresponding to the number of printing elements of the printing head, and said driving means drives the plurality of printing elements complementarily in a plurality of scannings so that printing lines by scanning of the head are complementarily printed with different printing elements.

10. A printing apparatus as claimed in claim 9, wherein said restriction means restricts the number of said plurality of printing elements complementarily driven by said driving means.

11. A printing apparatus as claimed in claim 1, said restriction means restricts the number of the plurality of printing elements continuously arranged.

12. A printing apparatus as claimed in claim 1, wherein the printing head is provided for each of a plurality of kinds of printing colors, said apparatus performs color printing by using the printing heads of respective printing colors, and said restriction means restricts the number of printing elements of respective printing heads of respective printing colors.

13. A printing apparatus as claimed in claim 12, wherein one of said printing heads is provided for the printing color of black, and said restriction means restricts the number of printing elements so that the number of times of driving the printing elements of the printing head of black color is restricted with a greater degree than other printing heads at a predetermined rate.

14. A printing apparatus as claimed in claim 1, wherein the predetermined number is determined according to a capacity of an electric power source for said printing apparatus.

15. A printing method for performing printing based on printing data by using a printing head in which a plurality of printing elements are arranged and scanning the printing head with respect to a printing medium in a direction different from a direction of an arrangement of the printing elements, comprising the steps of:

driving the plurality of printing elements of the printing head;

transporting the printing medium;

restricting a number of printing elements to be driven in one scanning of the printing head so that a number of times of driving of said plurality of printing elements driven during said one scanning becomes less than a predetermined number; and controlling transportation of the printing medium after said one scanning of the printing head such that an amount of transportation is varied so as to correspond to the number of printing elements restricted in one scanning.

16. A printing method for performing printing based on printing data by using a printing head in which a plurality of printing elements are arranged, and scanning the printing head with respect to a printing medium in a direction different from a direction of an arrangement of the printing elements, comprising the steps of:

sequentially detecting a number of times of driving the printing elements of the printing head with sequentially varying a size of a partial region obtained by dividing a scanning region of said printing head in a direction of the arrangement of the printing elements;

judging whether the sequentially detected number of times of driving is greater than a predetermined value; and performing printing by driving only a plurality of printing elements of the printing head corresponding to the partial region of the size relating to the detection while scanning in said scanning region when judgment is made that said number of times of driving is greater than said predetermined value.

17. A printing method as claimed in claim 16, wherein said step for detecting the number of driving detects the number of driving with sequentially increasing the size of the partial region.

18. A printing method as claimed in claim 16, wherein said step for detecting the number of driving detects the number of driving with sequentially decreasing the size of the partial region.

* * * * *

UNITED STATES PATENT AND TRADEMARK OFFICE

CERTIFICATE OF CORRECTION

PATENT NO. : 6,193,358 B1
DATED : February 27, 2001
INVENTOR(S) : Miyuki Fujita et al.

It is certified that error appears in the above-identified patent and that said Letters Patent is hereby corrected as shown below:

Title page,
Item [57] ABSTRACT,
Line 4, "direction." should read -- direction). --

Column 1,
Line 24, "or" should read -- and --;
Line 48, "an" should read -- a --;
Line 49, "according" should read -- according to --;and
Line 58, "elements" should read -- element --.

Column 2,
Line 30, "is" should read -- are --; and
Line 40, "method" should read -- methods --.

Column 3,
Line 44, "even if" should read -- even if the --; and
Line 61, "is corresponded" should read -- corresponds --.

Column 5,
Line 35, "opening" should read -- openings --;
Line 45, "divided" should read -- a divided --;
Line 50, "construion" should read -- construction --; and
Line 60, "EMBODIMENT" should read -- EMBODIMENTS --.

Column 6,
Line 1, "show" should read -- shows --;
Line 37, "carriage 702" should read -- carriage 706 --;
Line 57, "is" should read -- are --; and
Line 64, "the" should be deleted and "number" should read -- the number --.

Column 7,
Line 11, "is corresponded" should read -- corresponds --;
Line 15, "lateral" should read -- the lateral --;
Line 37, "to be" should read -- is --;
Line 38, "but also" should read -- but also why -- and "direction." should read -- direction is driven simultaneously. --;
Line 58, "in" should read -- to --; and
Line 63, "opening" should read -- openings --.

UNITED STATES PATENT AND TRADEMARK OFFICE

CERTIFICATE OF CORRECTION

PATENT NO. : 6,193,358 B1
DATED : February 27, 2001
INVENTOR(S) : Miyuki Fujita et al.

It is certified that error appears in the above-identified patent and that said Letters Patent is hereby corrected as shown below:

Column 8,
Line 12, "next" should read -- the next --;
Line 48, "in" should read -- where --; and
Line 67, "scan" should read -- scans --.

Column 9,
Line 7, "number" should read -- the number --;
Line 31, "number" should read -- the number --; and
Line 58, "prolong" should read -- a prolonged --.

Column 10,
Line 15, "hundreds" should read -- hundred --;
Line 16, "opens" should read -- openings --;
Line 20, "are corresponded" should read -- corresponds --;
Line 44, "is consisted" should read -- consists --; and
Line 45, "three-hundreds" should read -- three-hundred --.

Column 12,
Line 2, "forty-right" should read -- forty-eight --;
Line 15, "ejec- should be deleted;
Line 16, "tion openings" should be deleted;
Line 29, "consisted of" should read -- consisting of --;
Line 53, "As the" should read -- The --; and
Line 60, "that" should read -- those --.

Column 13,
Line 1, "With" should read -- When -- and "when" should read -- with --;
Line 15, "the block" should read -- block -- and "number" should read -- the number --;
Line 19, "hundreds" should read -- hundred --;
Line 27, "image $a_{n-1}$" should read -- image. ¶ $a_{n-1}$ --;
Line 35, "regions." should read -- region. --; and
Line 43, "step 1902," should read -- step S1902, --.

Column 14,
Line 13, "opening" should read -- openings --; and
Line 16, "opening" should read -- openings --.

UNITED STATES PATENT AND TRADEMARK OFFICE

CERTIFICATE OF CORRECTION

PATENT NO. : 6,193,358 B1
DATED : February 27, 2001
INVENTOR(S) : Miyuki Fujita et al.

It is certified that error appears in the above-identified patent and that said Letters Patent is hereby corrected as shown below:

Column 15,
Line 33, "to" should read -- into --.

Column 18,
Line 15, "said" should read -- wherein said --.

Signed and Sealed this

Twenty-seventh of November, 2001

*Attest:*

Nicholas P. Godici

NICHOLAS P. GODICI
*Acting Director of the United States Patent and Trademark Office*

*Attesting Officer*